US010934818B1

(12) United States Patent
Dreher

(10) Patent No.: US 10,934,818 B1
(45) Date of Patent: Mar. 2, 2021

(54) OSCILLATING HEAD WITH CONTIGUOUS COUNTERWEIGHT

(71) Applicant: George R Dreher, Midland, TX (US)

(72) Inventor: George R Dreher, Midland, TX (US)

( * ) Notice: Subject to any disclaimer, the term of this patent is extended or adjusted under 35 U.S.C. 154(b) by 0 days.

(21) Appl. No.: 16/709,679

(22) Filed: Dec. 10, 2019

Related U.S. Application Data

(62) Division of application No. 16/130,068, filed on Sep. 13, 2018, now Pat. No. 10,577,904.

(51) Int. Cl.

| | |
|---|---|
| ***F16H 21/32*** | (2006.01) |
| ***E21B 43/12*** | (2006.01) |
| ***F04B 47/14*** | (2006.01) |
| ***F04B 47/02*** | (2006.01) |

(52) U.S. Cl.
CPC ..... *E21B 43/127* (2013.01); *F04B 47/026* (2013.01); *F04B 47/14* (2013.01)

(58) Field of Classification Search
CPC ..... E21B 43/127; F04B 47/14; F04B 47/026
See application file for complete search history.

(56) References Cited

U.S. PATENT DOCUMENTS 3,016,767 A * 1/1962 Egan ..... F16F 15/28 74/589
6,325,142 B1 * 12/2001 Bosley ..... E21B 47/009 166/53
10,107,282 B1 * 10/2018 Dreher ..... F04B 47/145

* cited by examiner

*Primary Examiner* — Jake Cook

(57) ABSTRACT

A prime example of an application for a head with contiguous counterweight is a sucker rod reciprocating pump whose circular arc head is contiguous with a counterweight and is pivotably connected to the pitman arm, crank arm weight, and speed reducer. The pitman arm is substantially horizontal and the crank arm to wrist pin phase angle is about 70-90 degrees. Auxiliary counter weight extends from the head weight on a stinger and the head weights are adjustable. The head weight diameter is either constrained within the circular arc head's outer diameter or can be larger. The upper pitman bearings are outboard on the equalizer which is integral with the head. The center bearing of the head is outboard on the rectangular sampson post. The head counterweight increases permissible load on a speed reducer. This example use of a head with contiguous counterweight has can be configured to utilize beneficial embodiments for adjusting sampson post height and pitman arm length; and for changing the stroke length without removing the wrist pin from the crank weight hole.

1 Claim, 20 Drawing Sheets

OSCILLATING HEAD WITH CONTIGUOUS COUNTERWEIGHT

CROSS-REFERENCE TO RELATED APPLICATIONS

This is a division application Ser. No. 16/130,068, Filed Sep. 13, 2018, Granted on Sep. 13, 2018.

This application claims priority to and the benefit of the filing of U.S. Provisional Patent Application No. 62/411,556, filed on Oct. 22, 2016; U.S. Provisional Patent Application No. 62/403,165, filed on Oct. 2, 2016; U.S. Provisional Patent Application No. 62/421,410, filed on Nov. 14, 2016; U.S. Provisional Patent Application Ser. No. 62/426,337, filed on Nov. 25, 2016; U.S. Provisional Patent Application Ser. No. 62/535,846, filed on Jul. 22, 2017; U.S. Provisional Patent Application Ser. No. 62/535,945, filed on Jul. 23, 2017; and U.S. Non-Provisional patent application Ser. No. 15/719,964, filed on Sep. 29, 2017; U.S. Non-Provisional patent application Ser. No. 15/789,760, filed on Oct. 20, 2017; U.S. Non-Provisional patent application Ser. No. 15/810,083, filed on Nov. 12, 2017; U.S. Non-Provisional patent application Ser. No. 16/130,068, filed on Sep. 13, 2018; and the specifications and claims (if any) thereof are incorporated herein by reference.

BACKGROUND OF THE INVENTION

Field of the Invention (Technical Field):

Embodiments of the present invention relate generally to improved efficiency for lifting and lowering unbalanced loads.

Description of Related Art:

Lifting and lowering of loads has often been facilitated with the use of counterweight (counterbalance) to offset the load, in a manner to reduce the required force to raise and lower the load with the counterweight to be in some state of balance. Whether as in the intentionally unbalanced state, for example, in the Trebuchet beam, a fulcrum machine where a counterweight heavier than the load causes a beam with a fulcrum point to hurl a missile projectile from the opposite lighter beam end when the much heavier counterweight end drops; or in intentionally balanced modes, for example, an elevator, or a beam well pumping unit, often referred to as a "pump jack", the term "net force" or other synonyms can be used to describe a quantity of positive or negative force required to raise or lower a load after factoring in an attempt to balance or unbalance with counterweight in order to lighten or increase the load. "Gross torque" and other synonyms can be used to describe a quantity of torque required to raise or lower a load without or before an attempt to balance or unbalance with a counterweight—for example, a weight lifting exercise machine whose very purpose is to be heavy.

Gravity is the natural force being countered with the machine's counterbalance force, so with a fixed amount of load and fixed amount of counterweight the machine's required force is relatively constant. Some designs have attempted to improve lifting efficiency in various ways: by varying the angles of pull in the pulling machine, varying the length of linkages in the pulling machine, varying the size of pulleys in the pulling machine, and/or varying the speed reduction of pull in the pulling machine. In the case of beam pumping units which raise and lower a more or less vertical load there is a tipping (fulcrum) point and counterweight effort and load is intended to be in a close state of balance.

Machines designed to do heavy lifting are big and expensive and repairs on worn parts are expensive. The less force that is needed to accomplish the desired work, the smaller the machine components can be, and the less energy can be consumed accomplishing the work, and the less wear and tear on the machine occurs, and all this results in less expense to operate the machine, so designers have tried force-reducing designs in order to improve the economics of the lifting work.

Now we describe some design attempts to reduce the required lifting forces that are variations of both adjustable crank weight and beam weight "conventional" center tipping (fulcrum point) class 1 lever geometry and class 3 lever geometry (rear tipping-fulcrum point) that have attempted to reduce required counterweight in beam well pumping which in operation converts rotary motion of the prime mover, speed reducer, and crank arms, to vertical reciprocating motion of the pitman arms connected to the beam in order to facilitate rod pumping. Besides conventional class 1 geometry these variations can be front-mounted with rear fulcrum points as a class 3 lever, as in the first 1920s air balance units which still use air cylinder pressure as counterweight, and Parkersburg's "Monkey Motion" with fourteen bearing points which was entirely beam weighted with no crank arm weights which made the larger size beam weights bulky. However, both these designs allow more constant effective counterbalance than crank weighted with rotary motion counterweights as used in the 1930s "grasshopper" (Mark II) with class 3 rear fulcrum.

Deeper wells required more counterweight so massive units came of age in the early 1970s when the first sales order for the Mark II 1280 for Union Oil well in Farnsworth, Tex., was obtained by E.L. Hudson which started the era of massive crank weight pumping units when the Mark II's inventor Walter Trout instructed his engineer Joe Byrd to further refine the grasshopper design to accept the largest phased crank counterweight unit ever, and so came the first Mark II 1280.

One problem is that in beam pumped wells the lifted weight is about 1.5 times the weight of the lowered weight due to lifting the weight of the fluid plus the buoyant weight of the sucker rods in the pipe when lifting, but the fluid weight is then held by the downhole pump standing valve when lowered making lifting and lowering unbalanced, so in known references, the difference in counterweight required is split on the up stroke and down stroke which leaves significant unresolved net torque due to the unsolved unbalanced downhole condition.

With conventional beam units, massive effective counterweight is achieved with leverage of adjustable crank weight. But purely beam weighted units were built by Parkersburg and Cabot and others because the effective beam weight is direct and is more constant than rotary crank weight.

A phased crank design for conventional beam unit with class 1 lever center fulcrum point was published by George Eyler and Cabot Corporation in 1963. And an advanced geometry design was published by Bob Gault and Bethlehem Supply in 1965. These design elements require operating the unit in one direction only and mainly address effective counterweight applied to torque factor, which is a crank angle based multiplier from unit geometry that affects torque calculation at the speed reducer, and sometimes is able to reduce torque over "conventional" designs.

But, the air balance design can reverse direction and the gear teeth in the speed reducer are known for long life. This is partly because with easily adjusted air pressure the counterweight balance is easily maintained close to equal on upstroke and downstroke.

In 1984, Sam Gibbs introduced a wave equation that allowed well controllers to shut off pumping units when fluid in the well bore was low. Thus, variable frequency drives were introduced to seek better efficiency by slowing the pumping units or shutting them off when fluid in the well bore was low. This has led to many other intelligent controllers including speed controllers and soft reversing mechanisms.

All the designs mentioned can achieve a fairly limited increase in efficiency but still leave the problem of downhole unbalanced weight between lifting and lowering. So, there's much room for improvement—including the need for much greater efficiency regarding reduction of torque and net torque, in order to achieve longer lasting components, and reduced operating expense, reduced power consumption, longer stroke lengths and smaller speed reducers.

Some noteworthy patents:

| Pat. # | Date | Inventor | Class |
|---|---|---|---|
| 1,895,181 | Jan. 23, 1933 | W.C.TROUT | |
| 2,134,326 | Oct. 25, 1938 | R.G. DE LA MATER | 74-41 |
| 2,155,174 | Apr. 18 ,1939 | W.C. TROUT | 74-591 |
| 2,179,649 | May 4, 1939 | W.C. TROUT | ET AL 74-41 |
| 2,210,661 | Sep. 6 , 1940 | J.L. FINCHER/LUFKIN | 74-593 |
| 2,213,646 | Sep. 30, 1940 | A.M. BUTCHER | |
| 2,232,245 | Feb. 25, 1941 | R.G. DELAMATER | 74-539 |
| 2.293,915 | Sep. 25, 1942 | E.W. PATTERSON. | 74-589 |
| 2,915,919 | Dec. 8, 1959 | C.C. MITCHELL. | 74-590 |
| 3,310,988 | Mar. 28, 1967 | R.H. GAULT. | 74-41 |
| 3,406,581 | Oct. 22, 1968 | G. EYLER. | 74-41 |
| 4,490,094 | Dec. 25, 1984 | S.G. GIBBS | 417/42, 417/22X, 417/53X, 22-24 |

BRIEF SUMMARY OF EMBODIMENTS OF THE PRESENT INVENTION

Embodiments of the present invention relate to lifting and lowering an unbalanced load with a head contiguous with a counterweight having a fulcrum and connected to a load and an effort.

In one embodiment, a sucker rod pumping unit, the lifting and lowering of the well load can be caused by the reciprocating motion of a head tipping on a fulcrum and counterbalanced with an counterweight contiguous to the head.

In one embodiment, when maximum counterweight effect for lifting the unbalanced well load is needed, which occurs at the same time as lowering the crank arm, the head's counterweight is oscillated by linkages, timed for maximum offsetting of the well load. Vice versa, when minimum counterbalance effect for lowering the well load is desired, which occurs at the same time as raising the crank arm, the head's counterweight is oscillated by linkages, timed for minimum offsetting of the well load.

In one embodiment, the combination of head weight and crank weight facilitate the increased counterbalance effect required to raise the rods and the decreased counterbalance effect required to lower the rods, due to raising the rods requiring lifting the weight of the rods in fluid plus the weight of the fluid, and lowering the rods requiring only the weight of the rods in fluid. Head with contiguous counterweight increases permissible load, reduces net torque and lowers structural stress and fatigue to allow longer life speed reducers, smaller speed reducers, and longer reciprocating vertical stroke length which are economic and performance benefits.

The pitman arms are substantially horizontal so the head can be contiguous to a counterweight and the crank arm to wrist pin phase angle can be 70 degrees more or less to improve geometry.

The head weight is contiguous to be integral with the head. There can be a counter weight extending from the head on a stinger and the stinger can be adjustable.

For an extra low profile unit the size of the head weight is constrained within the head's outer diameter. Or for a regular low profile unit the head weight diameter can be larger than the bridle runner outer diameter making room for more counterweight and a counter weight stinger to extrude.

For added stability and strength the upper pitman bearings can be outboard on the outsides of the head and the bearing shaft can be integrated within the head with an equalizer.

For added stability and strength the saddle bearings can be outboard on the Sampson post water table and the saddle shaft can be integrated with the head with an equalizer.

For added stability and strength the equalizer beam can be integrated with the head.

A four sided Sampson post can be used to accommodate the head counter weight diameter and width.

The counterbalance effect contiguous with the head smoothens the speed reducer loading. And for additional vibration and shock reduction hard rubber dampeners can be used wherever possible on the connection points for wrist pin, pitman arm, saddle bearing, and sampson post.

The head diameter can be sized larger for regular profile units or smaller for low profile units.

The four bar linkage dimensions are specific to the horizontal pitman arm geometry and sized to achieve low material stress, low torque factor, optimal rod acceleration and velocity.

A horizontally level plane for saddle shaft and crank shaft heights can be used efficiently. A saddle shaft and crank shaft height above ground that's not equal affects torque factor and rod acceleration and the four bar mechanism must be intentionally designed to fit operational parameters For visualization purposes let's say pitman arm length can be about 1 to 10+ times wrist pin to crank shaft radius but is more often suitable in the longer range.

And crank shaft to wrist pin radius is less than upper pitman to saddle radius.

A larger outer diameter of the head area for running the flexible connector to the downhole rods relative to the upper pitman bearing increases the stroke length.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DESCRIPTIVE KEY

Figure 1:
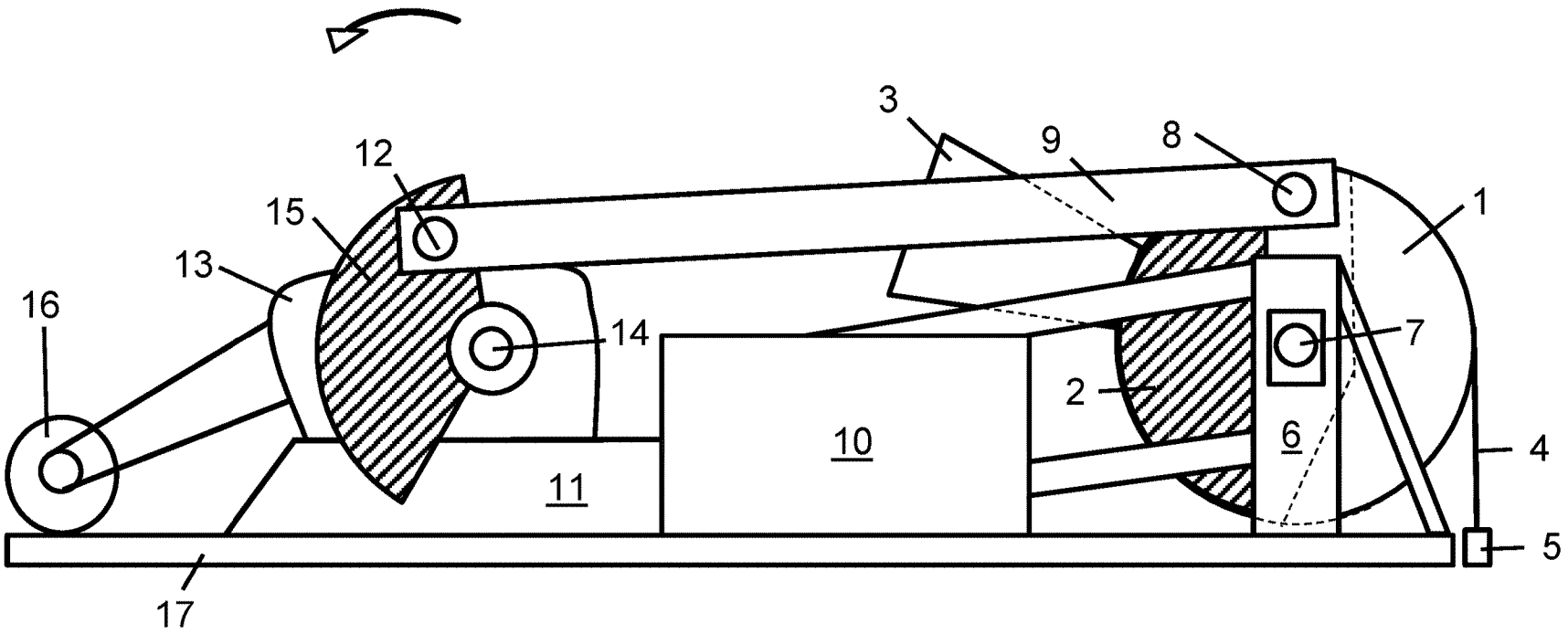
FIG. 1 side view of apparatus with head with contiguous counterweight and extended weight, in extra low profile embodiment.

1 removable section of head
2 head weight
3 extended weight
4 flexible connector
5 well load
6 sampson post
7 center bearing
8 upper pitman
9 pitman arm
10 support
11 pedestal
12 wrist pin
13 speed reducer
14 crank shaft
15 crank arm weight
16 prime mover
17 skid
18 stinger
19 equalizer
20 saddle support
21 head support
22 pitman arm expansion assembly
23 extendable pitman arm
24 sampson post elevator
25 stinger weight
26 pitman arm spacer
27 adjustable stroke length assembly
28 wrist pin hole
29 position locking device

DETAILED DESCRIPTION OF THE INVENTION

As used throughout this application, the term "counterbalance" is intended to mean the amount of effective weight the dead weight of the block of steel called "counterweight" 2 must exert to effect a desired result on a well load 5. The term "weight" and "dead weight" when referring to a "counterweight" 2, is used for the sake of simplicity and is not intended to limit the "counterweight" 2, instead, the term "weight" and "dead weight" when used in the context of the "counterweight" 2 is intended to include any and all manners of a "counterweight" 2, including but not limited to oscillating head weight 2 and thus reciprocating counterweight 2, counter weight and counter-weight.

As used throughout this application, the term "net torque" is intended to mean the amount of torque that speed reducer 13 or prime mover 16 must exert to effect a desired result on a well load 5.

As used throughout this application, the term "unbalanced load" on a pumping unit is intended to mean where the load in the lift direction exceeds the load in the return direction.

In accordance with embodiments of the invention, the best mode is presented in terms of the described embodiments, herein depicted within FIG. 1 through FIG. 25. However, the disclosure is not limited to the described embodiments and, upon studying the instant application, a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only certain configurations have been shown and described for purposes of clarity and disclosure and not by way of limitation of scope.

It can be appreciated that, although such terms as first, second, etc. may be used herein to describe various elements, these elements should not be limited by these terms. These terms are only used to distinguish one (1) element from another element. Thus, a first element discussed below could be termed a second element without departing from the scope of the present invention. In addition, as used herein, the singular forms "a", "an" and "the" are intended to include the plural forms as well, unless the context clearly indicates otherwise. It also will be understood that, as used herein, the term "comprising" or "comprises" is open-ended, and includes one (1) or more stated elements, steps or functions without precluding one (1) or more unstated elements, steps or functions. Relative terms such as "front" or "rear" or "left" or "right" or "top" or "bottom" or "below" or "above" or "upper" or "lower" or "horizontal" or "vertical" may be used herein to describe a relationship of one (1) element, feature or region to another element, feature or region as illustrated in the figures. It should be understood that these terms are intended to encompass different orientations of the device in addition to the orientation depicted in the figures. It should also be understood that when an element is referred to as being "connected" to another element, it can be directly connected to the other element or intervening elements may be present. It should also be understood that the sizes and relative orientations of the illustrated elements are not shown to scale, and in some instances they have been exaggerated for purposes of explanation.

Embodiments of the present invention can be used in conjunction with the four bar mechanism and linked to work as a reciprocating rod pump.

Of the many applications that embodiments of the present invention apply to, now consider an embodiment of the present invention as applied to class 1 lever, in this particular example geometries of a pumping unit where circular motion is transferred from prime mover 16 to speed reducer 13 and rotating crank arm weight 15 and then converted to linear motion with crank arm weight 15 wrist pin 12 articulating pitman arm 9 connected through upper pitman 8 at equalizer 19 cross beam integral to a head 1 contiguous with a counterweight 2.

We are describing an invention which is an apparatus used to reciprocate a downhole rod pump connected to the surface by a rod or rods for the purpose of lifting fluid from a well bore This invention is an apparatus which is uniquely comprised of a circular arc head 1 contiguous to a counterweight. 2.

This circular arc head 1 contiguous to a counterweight 2 is pivotably connected to an upper pitman 8 which connects to a pitman arm 9 which is pivotably connected to a wrist pin 12. The pitman arm 9 is actuated by the circular motion of the wrist pin 12 which is pivotably attached to the crank arm weight 15 whose motion is rotational and whose motive force can be induced by a speed reducer; 13 and this rotational motion is translated to linear motion by the pitman arm 9 which oscillates the head 1 which has a circular arc with a flexible connector 4 which can be comprised of a wire rope and a hanger bar to connect it to the downhole well load 5.

Thus the pitman arm 9 is disposed in a substantially horizontal direction and thereby provides a substantially horizontal motion to the upper pitman 8 pivotably connected to oscillate the circular arc of the head 1 which is contiguous to the counterweight 2; and this assembly is connected to the flexible connector 4 which translates the oscillating circular arc motion to a vertical reciprocation of the connected load 5 which can be but is not limited to being a rod connecting to a downhole pump.

The counterweight 2 which is contiguous to the circular arc head 1 provides a means for counterbalance effect; and there is a crank arm weight 15 also providing a means for counterbalance effect. The tandem combination of head weight 2 and crank arm weight 15 combine to provide counterbalance effect sufficient to reciprocate the downhole load 5; the head counterweight 2 provides a dynamic means of shock and vibration dampening which relieves structural stress of the apparatus.

The apparatus operates an unbalanced load and lifts the weight of fluid and rods on the upstroke and lowers the weight of rods on the downstroke. Lifting and lowering of these weights utilizes counterbalance by linkage of the crank arm weight 15 which is pivotably connected to the pitman arm 19 which is pivotably connected to the circular arc head 1 contiguous to a head counterweight 2 in such a way that link dimensions are advantageous for providing a means to synchronize timing to achieve the most efficient counterbalance moment to offset the unbalanced load 5 which is in relation to and multiplied by the torque factor;

The crank arm weight 15 counterbalance effect is proportional in relation with the crank arm weight 15 angle and is linked by the pitman arm 19 to be in time with the head 1; and, the circular arc head 1 is contiguous to head counterweight 1 counterbalance effect which is proportional in relation to the leverage provided by head counterweight 2 angle as it is linked to the well load 5.

The upper pitman 8 is pivotably connected to the head 1 and can be disposed either near to the top of head 1 requiring counterclockwise rotation with the well to the right, or near to the bottom of the head 1 requiring clockwise rotation with the well to the right.

The pitman arm 9 pivotably connected to the circular arc head 1 which is contiguous to a head counterweight 2 has a length greater than one to ten or more times the radius length of the circular arc head 1 which is contiguous to a head counterweight 2. There is readily available software available to design for specific speed and acceleration of the well load 5 with a four bar mechanism such as this apparatus, and also torque factor software is readily available so that manufacturers can design with dimensions to achieve desired kinematic behavior.

The distance from the upper pitman 8 to the center bearing 7 disposed in the center of the circular arc head 1 is at either less than, greater than, or equal to the distance from the center bearing to the flexible connector 4 on the circular arc of the head 1 contiguous to the head counterweight 2.

The distance of the wrist pin 12 on the crank arm weight 15 to the crank shaft 14 in the speed reducer 13 is either less than, more than, or equal to the distance of the upper pitman 8 to the center bearing 7 which is pivotably connected to the circular arc head 1 which is contiguous to the head weight 1 counterweight.

A torque factor is translated by the four bar geometry links to a speed reducer 13 which is configured by the dimensions of links from a circular arc head 1 contiguous to a head counterweight 2, to a pitman arm 9, a crank arm weight 15, and a speed reducer 13. There is readily available torque factor software to design dimensions for this apparatus so that manufacturers can achieve the mechanical behavior they intend.

The head 1 incorporates member links in a four bar mechanism, the four bar mechanism has dimensions achieving kinematic behavior suitable for a downhole rod pump so as to compliment pumping parameters; and has substantially horizontal oriented pitman arms 8; and is linked to have a kinematic behavior to cause either a fast upstroke, and or a fast downstroke, and or substantially equal speed on upstroke and downstroke; it can be linked in a multitude of geometries to cause a multitude of sucker rod velocity and acceleration variations; including but not limited to satisfy well engineers recommendations intended to facilitate including but not limited to a large pump plunger diameter, and recommendations to accentuate fiber glass rod stretch and rebound; and recommendations to facilitate pump configurations designed to pump gaseous fluid; or recommendations to facilitate pump configurations designed to pump fluid with high solids content.

Using readily available software various torque factor computations for various embodiments of this apparatus have been computed. Various velocity and acceleration computations for various embodiments of this apparatus have been computed. Various head counterweight 2 momentum computations for various embodiments of this apparatus have been computed.

Using readily available software various permissible load computations for various embodiments of this apparatus have been computed. The oscillating head 1 being contiguous to a head counterweight 2 causes a higher permissible load on a speed reducer 13 of a downhole rod pump because the counterbalance effect of the head weight 1 counterweight 2 is being disposed contiguously at the head 1 to directly offset a load on the flexible connector 4 of the head 1; this subsequently reduces the counterbalance effect required at the crank arm weight 15 which is directly connected to the speed reducer 13 and this increases the permissible load on the speed reducer 13.

Velocity and acceleration of downhole pump designed for kinematic behavior of four bar geometry can also have additional immediate control of upstroke and downstroke by utilizing a speed controller and soft reversing mechanism.

The substantially horizontal motion of a pitman arm 9 pivotably connected to an upper pitman 8 oscillates a head 1 which is contiguous to a head counterweight 2 that is pivotably connected to a center bearing 7; and, the circular arc head 1 which is contiguous to a head counterweight 2 is connected with a flexible connector 4 extending vertically downward to connect with a load 5 in the well bore which is sucker rods and a downhole pump and fluid lifted.

The substantially horizontal motion of the pitman arm 9 is pivotably connected to the upper pitman 8 and thereby oscillates the circular arc of the head 1 which is contiguous to the head counterweight 2 so that circular motion of the crank arm weight 15 is translated to vertical reciprocation of the downhole rod pump; and the flexible connector 4 which is connected to the circular arc head 1 which is contiguous to the head counterweight 2 is thusly reciprocating the load 5 of sucker rods and downhole rod pump to lift fluid.

The head 1 contiguous to the head counterweight 2 and pivotably connected to the crank arm weight 15 are together providing counterbalance effect in tandem; so both the head 1 which is contiguous to a head counterweight 2 and is pivotably connected to a crank arm weight 15 are providing a means in tandem for sufficient low profile counterbalance effect to allow systems with low height to pass overhead.

The oscillating circular arc head 1 is contiguous to a head counterweight 2 which is linked to members of the apparatus for providing sufficient effective counterbalance to offset a load from the well on the circular arc of the head 1; and, the oscillating circular arc head 1 contiguous to a head counterweight 2 is also linked to the crank arm weight 15 to achieve a tandem counterbalance effect.

The apparatus has a profile such that the height is not greater than the diameter of the extent of the head 1 contiguous to a head counterweight 2 or the diameter of the extent of a crank arm weight 15 swing; and, it has mechanical links such that the geometry utilizes the circular arc head 1 contiguous to a head counterweight 2 to provide a low profile for the apparatus to reside under certain height limitations;

The oscillating circular arc head 1 is contiguous to a head counterweight 2, and the head counterweight 2 is a dense mass that resides on substantially the opposite side from the load 5 on the circular arc of a head 1 which is pivotably attached to a center bearing 7 which provides oscillation of the head 1.

The head counterweight 2 which is contiguous to a head 1 is providing a dynamic means for dynamic shock and vibration dampening effect; also, dampeners, such as but not limited to hard rubber or high durometer such as 70D-80D polyurethane, on the circular arc head 1 which is contiguous to the head counterweight 2 are sandwiching at least one of an upper pitman 8, an equalizer 19, a center bearing 7, and a sampson post 6 to the head 1. The upper pitman 8 which is pivotably connected to the circular arc head 1 which is contiguous to the head counterweight 2 and is pivotably connected by means of a center bearing 7 to a sampson post 6; and, the sampson post 6 is cushioned with at least one of some type of a shock dampener and vibration dampener, and the sampson post 6 is stabilized with supports and braces. For bearing material manufacturers could consider high durometer such as 70D-80D graphite filled polyurethane.

The head counterweight 2 is disposed contiguously with the head 1 to provide direct counterbalance effect to offset a load 5 connected on substantially the opposite side and this provides a dynamic means to either dampen and or smoothen either the vibration and or shock dynamics of the reciprocating downhole rod pump apparatus; and, this dynamic means by the head counterweight 2 of dampening and or smoothening the vibration and or shock increases the mechanical life and or the durability the apparatus.

The cushioning dampeners sandwiching the members of this reciprocating rod pump with an oscillating circular arc head 1 which is contiguous to a head counterweight 2 are comprised of a means for shock and or vibration dampening; and, certain embodiments include but are not limited to a mechanical dampener; and, an elastomer dampener; and, a spring coil dampener; and, a hydraulic dampener; and, a magnetic dampener.

In one embodiment the head counterweight 2 can be a plurality of dense masses residing on substantially the opposite side from the load 5 on the oscillating circular arc of the head 1; and in one embodiment the head counterweight 2 amount is adjustable; and in one embodiment the head counterweight 2 position is adjustable; and in one embodiment an adjustable weight extends 3 from the head counterweight 2 which is contiguous to the head 1; and in one embodiment an adjustable weight extends 3 on a stinger 18; and in one embodiment an adjustable weight on a stinger 18 can be adjusted for weight amount; and in one embodiment the extension angle for the adjustable weight on a stinger 18 can be adjusted.

The head 1 is part of a downhole rod pump that requires periodic well maintenance so the circular arc section of the head 1 is easily removable by the service crew; and thus the removable section of the circular arc head 1 facilitates periodic well maintenance.

In one embodiment the apparatus to reciprocate a downhole rod pump for lifting fluid from a well bore the sampson post 6 height is adjustable by a service crew at the operator's discretion after the apparatus has left the original equipment manufacturer by embodiments including but not limited to adding a sampson post elevator 24 which can be a spacer and can be easily inserted between the skid 17 and the sampson post 6 for elevation to achieve a desired kinematic behavior.

In one embodiment the pitman arm 9 length is extendable by a service crew at the operator's discretion after the apparatus has left the original equipment manufacturer so the apparatus can accommodate new geometry from a sampson post elevation 24 or whatever desired design of crank arm weight 15 phase angle to achieve the operator's desired kinematic behavior. Embodiments to adjust pitman arm 9 length include but are not limited to inserting a pitman arm spacer 26 of suitable material such as but not limited to I-beam or C-channel; or utilizing a pitman arm expansion assembly 22 such as but not limited to fastening C-channel or I-beam with nuts and bolts or rivets.

In one embodiment the stroke length is adjustable without removing the wrist pins 12 from their holes 28; embodiments include but not limited to an adjustable stroke length assembly 27 which can be positioned where desired on the crank arm weight 15 and then secured and locked down.

Service crews can reverse the direction of this phased crank apparatus by removing the crank arm weight 15 and re-installing on the opposite side of the crankshaft 14; and by removing the head 1 and turning the head 1 over and re-installing. Reversing the direction of apparatus causes loading on the opposite side of the speed reducer force mechanism, such as but not limited to gear tooth or sprocket tooth, which over time allows more even tooth wear. Reversing the direction of apparatus causes structural stresses to locate in different areas allowing for design changes in supports and braces at the designer's discretion.

These modifying embodiments enable adjustment at the operator's discretion by service crews after the apparatus has left the original equipment manufacturer providing for a means for multitudes of kinematic configurations that are operator enabled; thus various downhole rod pump well bore conditions can be optimized at the operator's discretion for lifting fluid after the apparatus has left the original equipment manufacturer.

Figures in the drawings with upper pitman arms 8 connected near the top of the head 1 illustrate the crank arm weight 15 rotation in counter clockwise direction with the well on the right.

Figure 11:
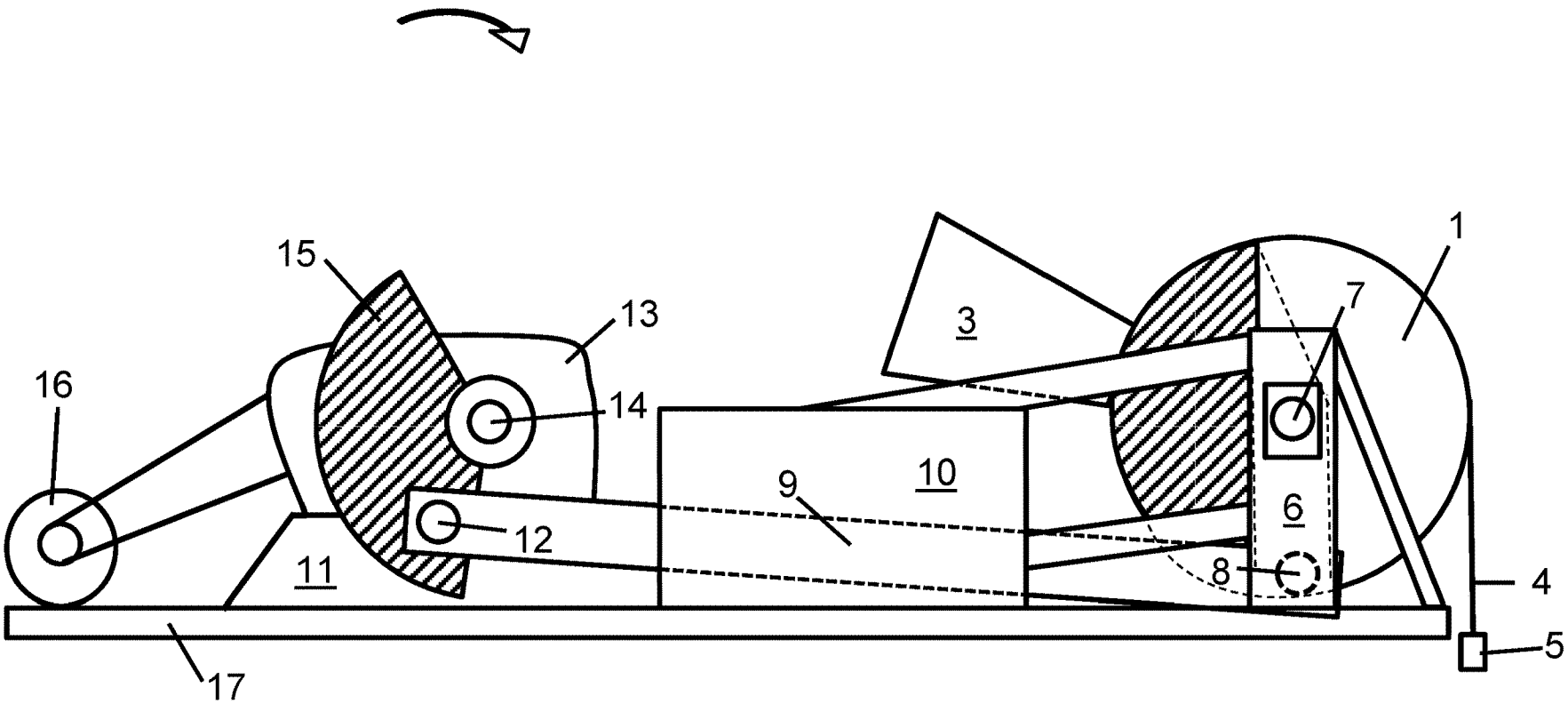
FIG. 11 side view of apparatus with head with contiguous counterweight and extended weight, in extra low profile with lower connected pitman arms embodiment.
Figure 12:
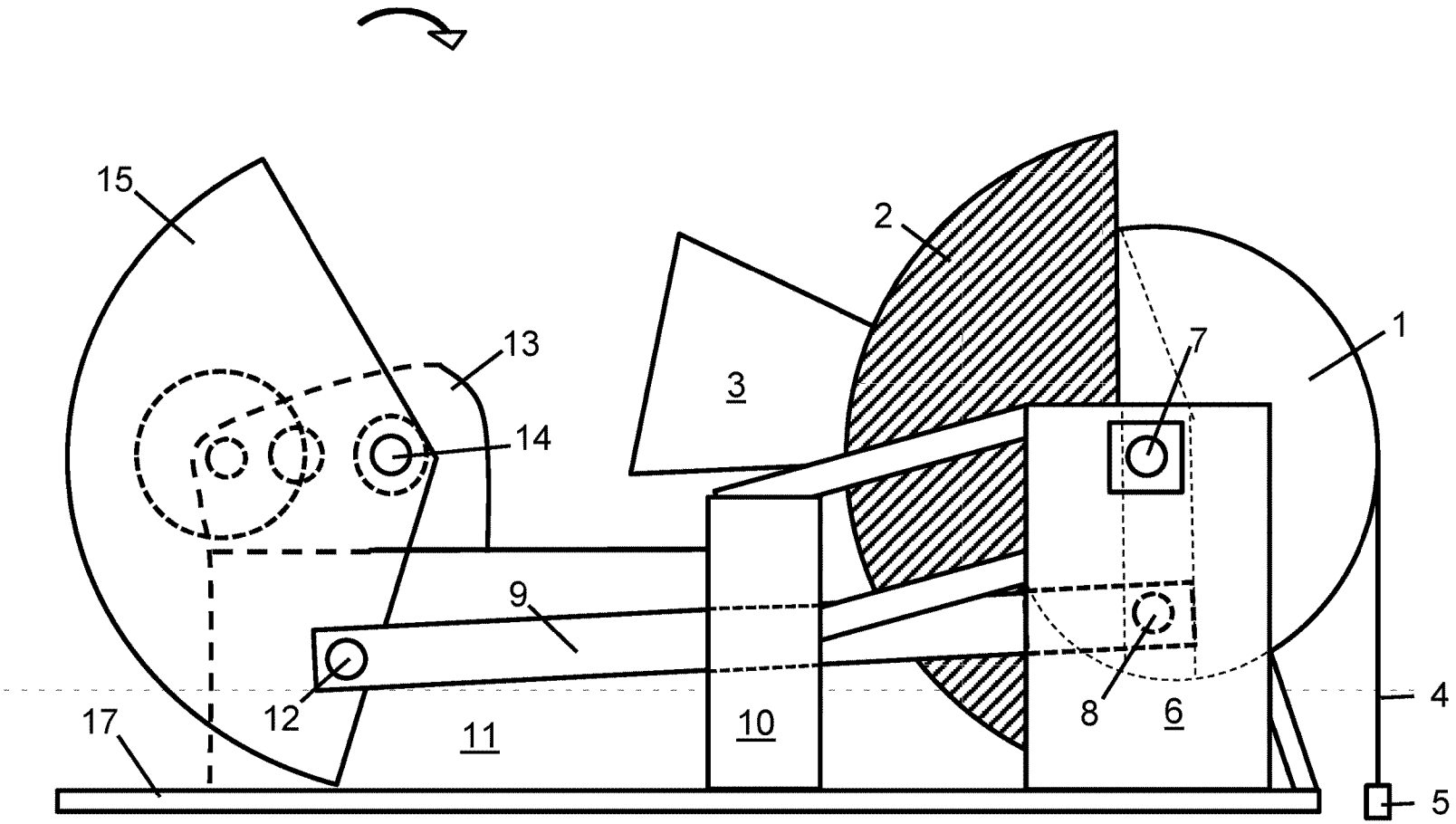
FIG. 12 side view of apparatus with head with contiguous counterweight and extended weight, in low profile with lower connected pitman arms embodiment.
Figure 13:
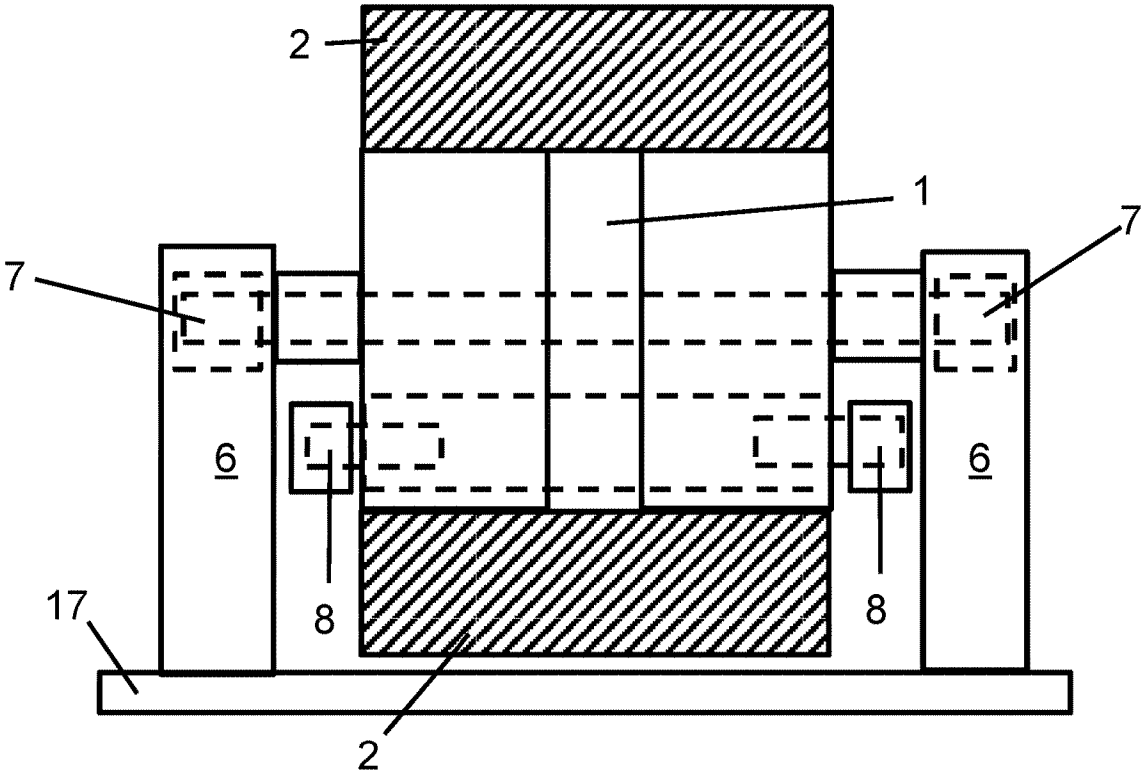
FIG. 13 front view of head assembly with contiguous counterweight and extended weight, in low profile with lower connected pitman arms embodiment.

FIG. 11-13 in the drawings with lower pitman arms 8 connected near the bottom of the head 1 illustrate the crank arm weight 15 rotation in counter clockwise direction with the well on the right.

FIG. 1 illustrates an embodiment wherein the apparatus is extra low profile, meaning the head 1 and contiguous counterweight 2 and the crank arm weight 4 are the same diameter which achieves the extreme low profile for the apparatus but also limits the quantity of effective counterbalance, so this illustration shows an embodiment to increase effective counterbalance with an extended weight 3 attached to the counterweight 2 in a way such that it can adjustably slide and is positioned such that in the upstroke it will still be floor clearing.

Figure 2:
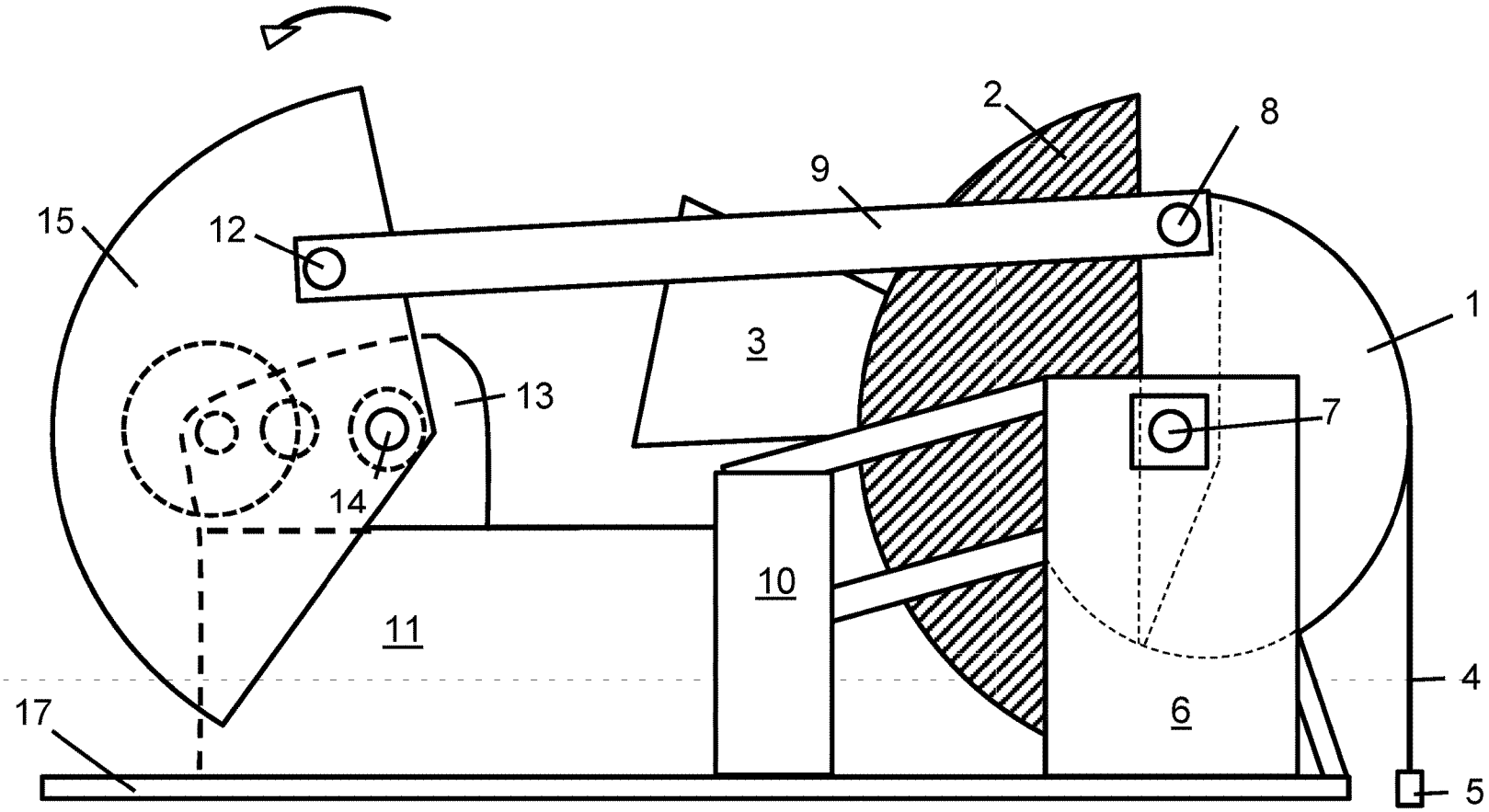
FIG. 2 side view of apparatus with head with contiguous counterweight and extended weight, in low profile embodiment.

FIG. 2 illustrates an embodiment wherein the apparatus is low profile, meaning the contiguous counterweight and the crank arm weight 15 are a larger diameter than the head 1 and still achieves a low profile for the apparatus but limits the quantity of effective counterbalance, so this illustration shows an embodiment to increase effective counterbalance with an extended weight 3 attached to the counterweight 2 in a way such that it can adjustably slide and is positioned such that in the upstroke it will still be floor clearing.

Figure 3:
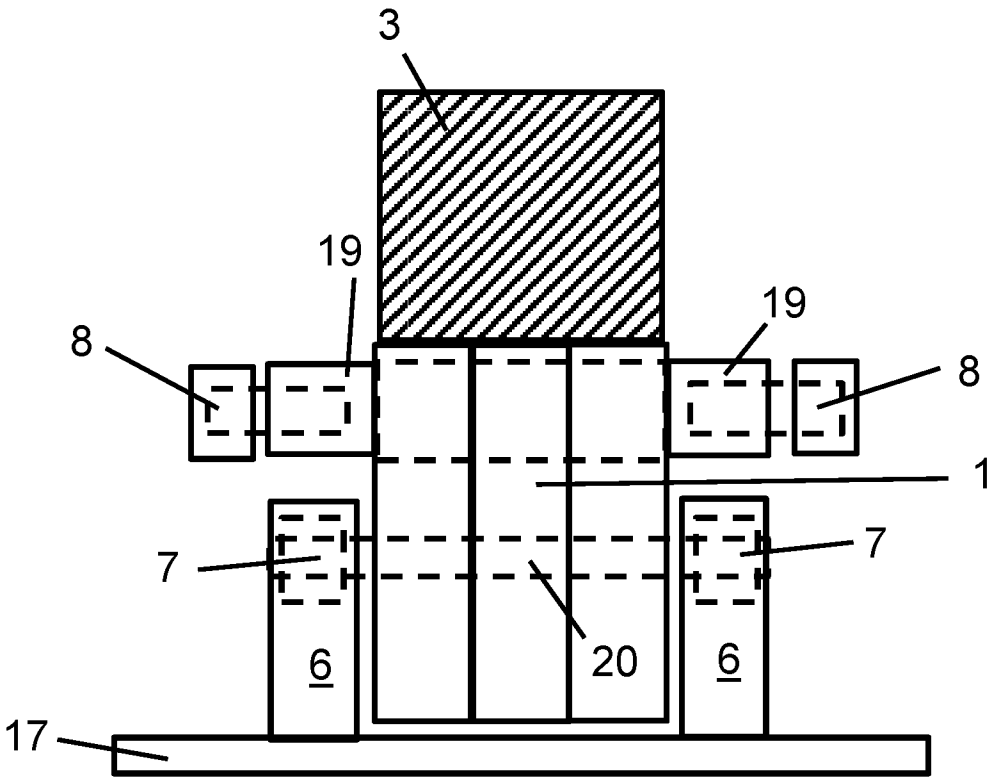
FIG. 3 front view of head assembly with contiguous counterweight and extended weight, in extra low profile embodiment.

FIG. 3 illustrates an embodiment wherein the front view of the head 1 assembly of the apparatus is extra low profile, meaning the head 1 and contiguous counterweight 2 and the crank arm weight 15 are the same diameter which achieves the extra low profile for the apparatus but also limits the quantity of effective counterbalance available, so this illustration shows an embodiment to increase effective counterbalance with an extended weight 3 attached to the counterweight 2 which in this view is in the downstroke with the extended weight 3 sticking up above the head 1 profile.

Figure 4:
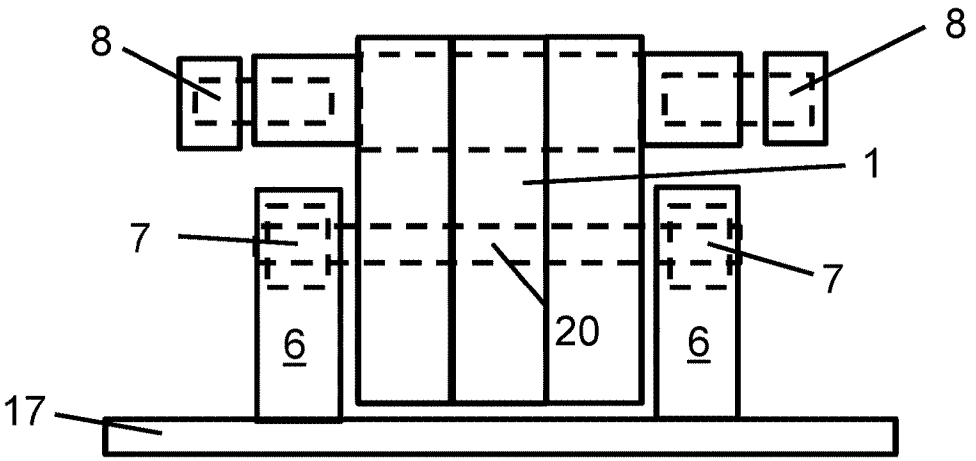
FIG. 4 front view of head assembly, in extra low profile embodiment without extended weight.

FIG. 4 illustrates an embodiment wherein the front view of the head 1 assembly of the apparatus is extra low profile, meaning the head 1 and contiguous counterweight 2 and the crank arm weight 15 are the same diameter which achieves the extra low profile for the apparatus. In this embodiment both the upper pitman 8 and the center bearing 7 are outboard which offers good stability, but there are other bearing configurations possible in other embodiments.

Figure 5:
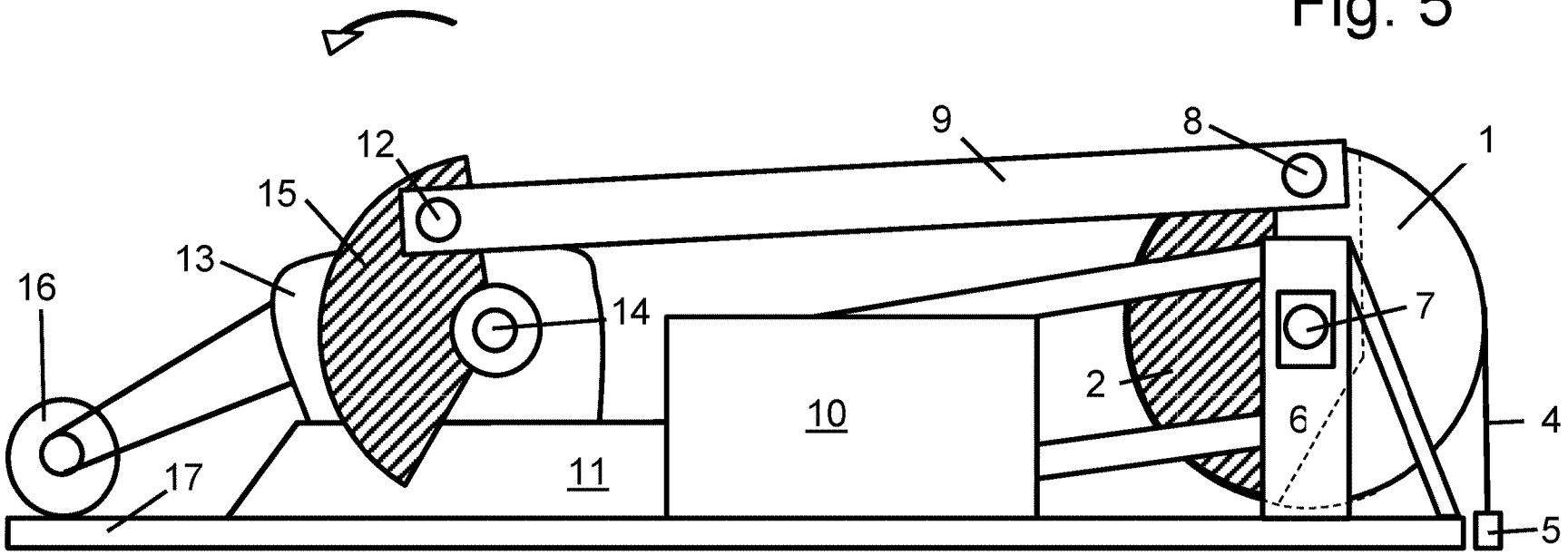
FIG. 5 side view of apparatus with head with contiguous counterweight without extended weight, in extra low profile embodiment.

FIG. 5 illustrates an embodiment wherein the apparatus is extra low profile, meaning the head 1 and contiguous counterweight 2 and the crank arm weight 15 are the same diameter which achieves the extra low profile for the apparatus but also limits the quantity of effective counterbalance. Systems with low clearance requirements like irrigation systems can pass over this embodiment.

Figure 6:
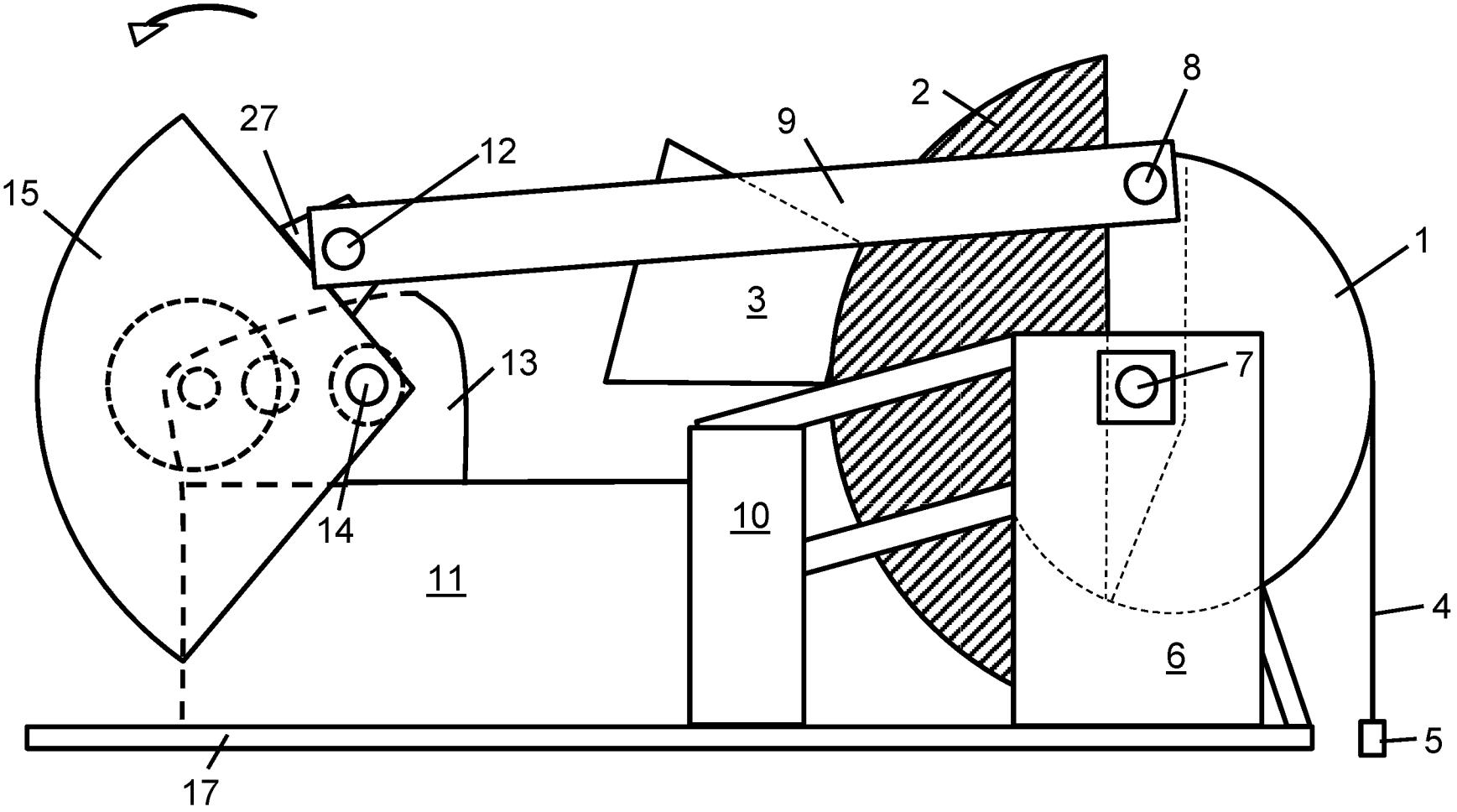
FIG. 6 side view of apparatus with head with contiguous counterweight and extended weight crank arm weight at 270 degrees, in low profile with adjustable stroke length assembly embodiment.

FIG. 6 illustrates an embodiment wherein the low profile configuration is at 270 degrees showing the adjustable stroke length assembly 27 and extended weight 3 attached to crank arm weight 15.

Figure 7:
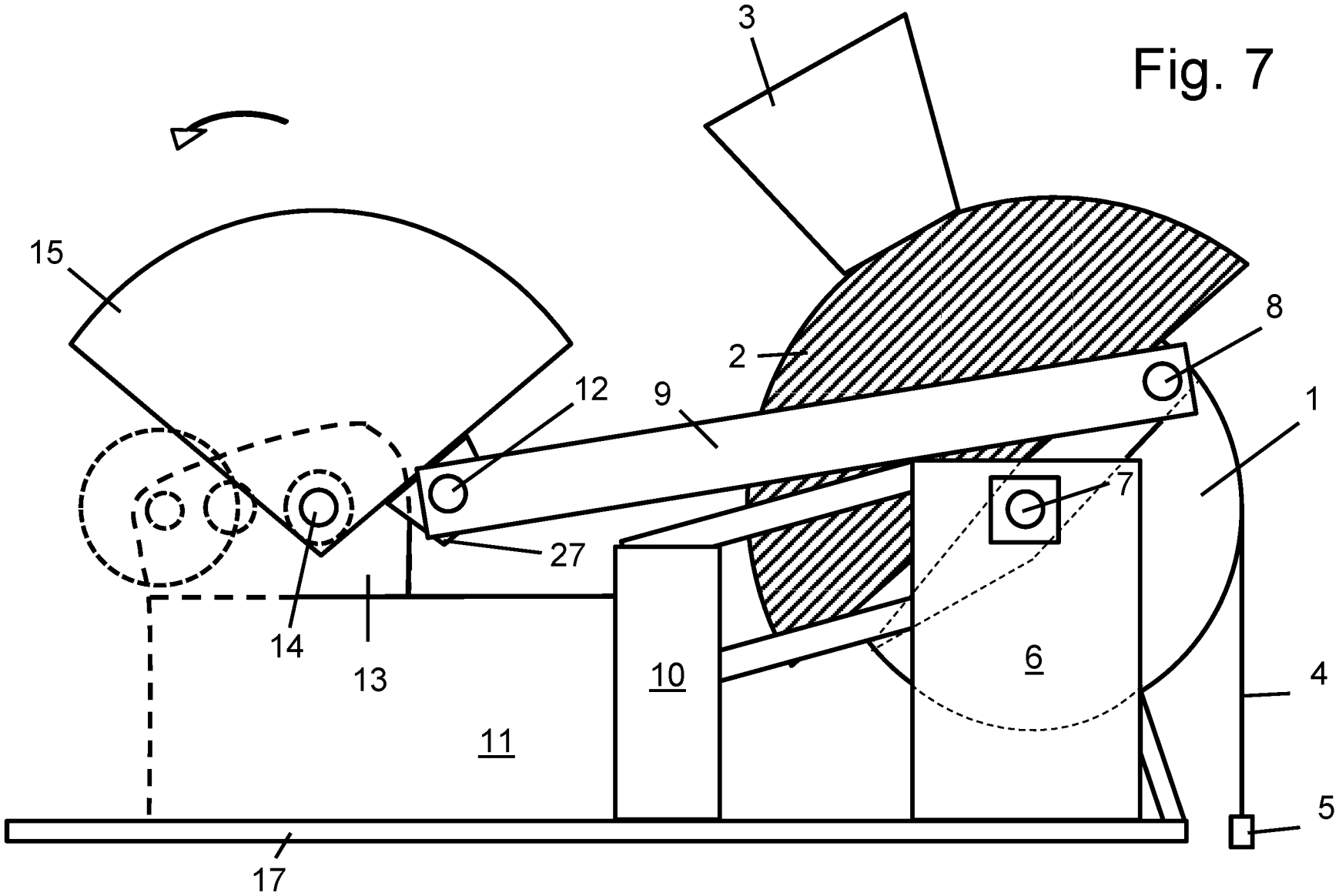
FIG. 7 side view of apparatus with head with contiguous counterweight and extended weight crank arm weight at 0 degrees, in low profile with adjustable stroke length assembly embodiment.

FIG. 7 illustrates an embodiment wherein the low profile configuration is at 0 degrees with the adjustable stroke length assembly 27 and extended weight 3 attached to crank arm weight 15.

Figure 8:
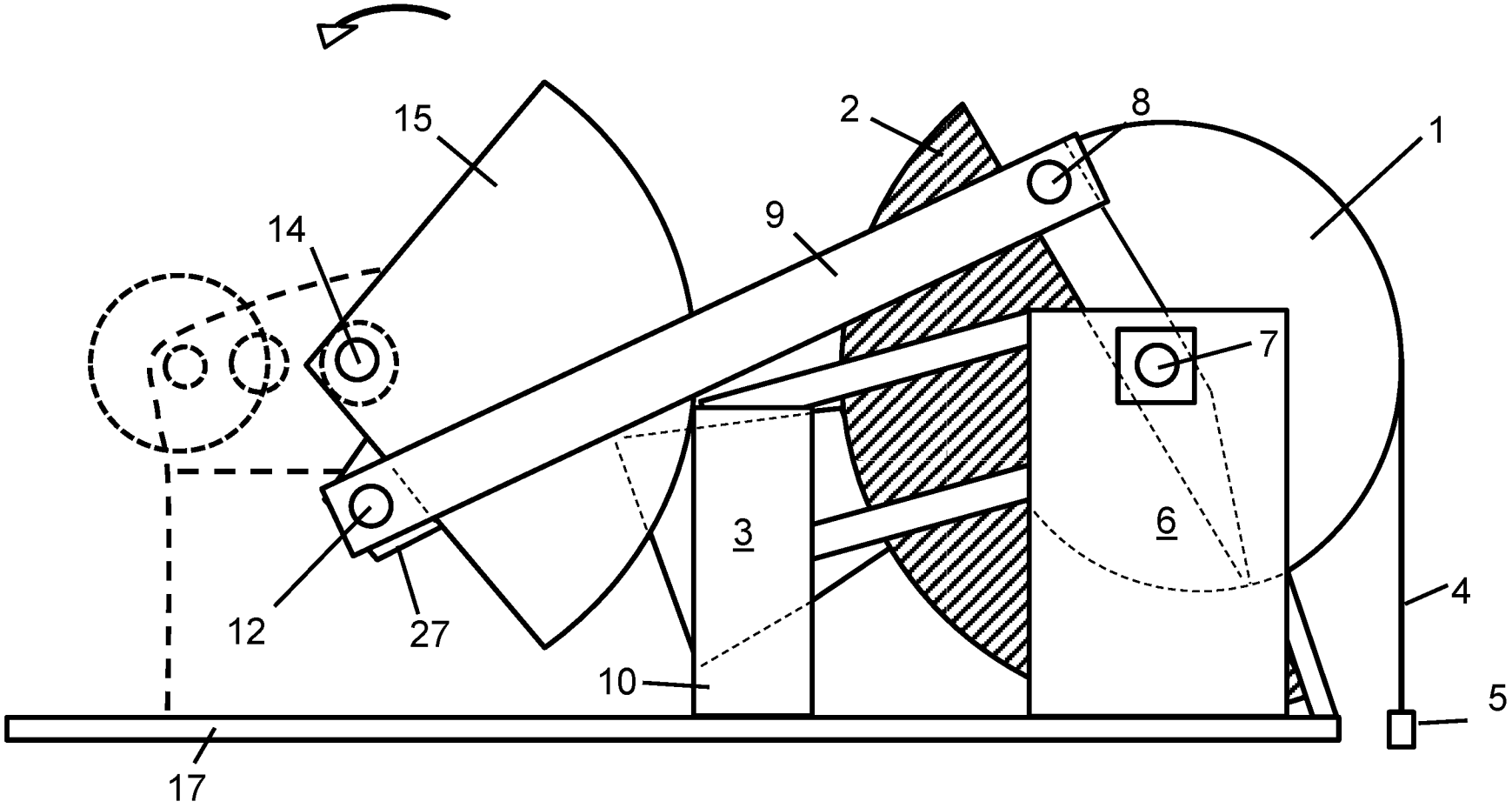
FIG. 8 side view of apparatus with head with contiguous counterweight and extended weight crank arm weight at 90 degrees, in low profile with adjustable stroke length assembly embodiment.

FIG. 8 illustrates an embodiment wherein the low profile configuration is at 90 degrees with the adjustable stroke length assembly 27 and extended weight 3 attached to crank arm weight 15.

Figure 9:
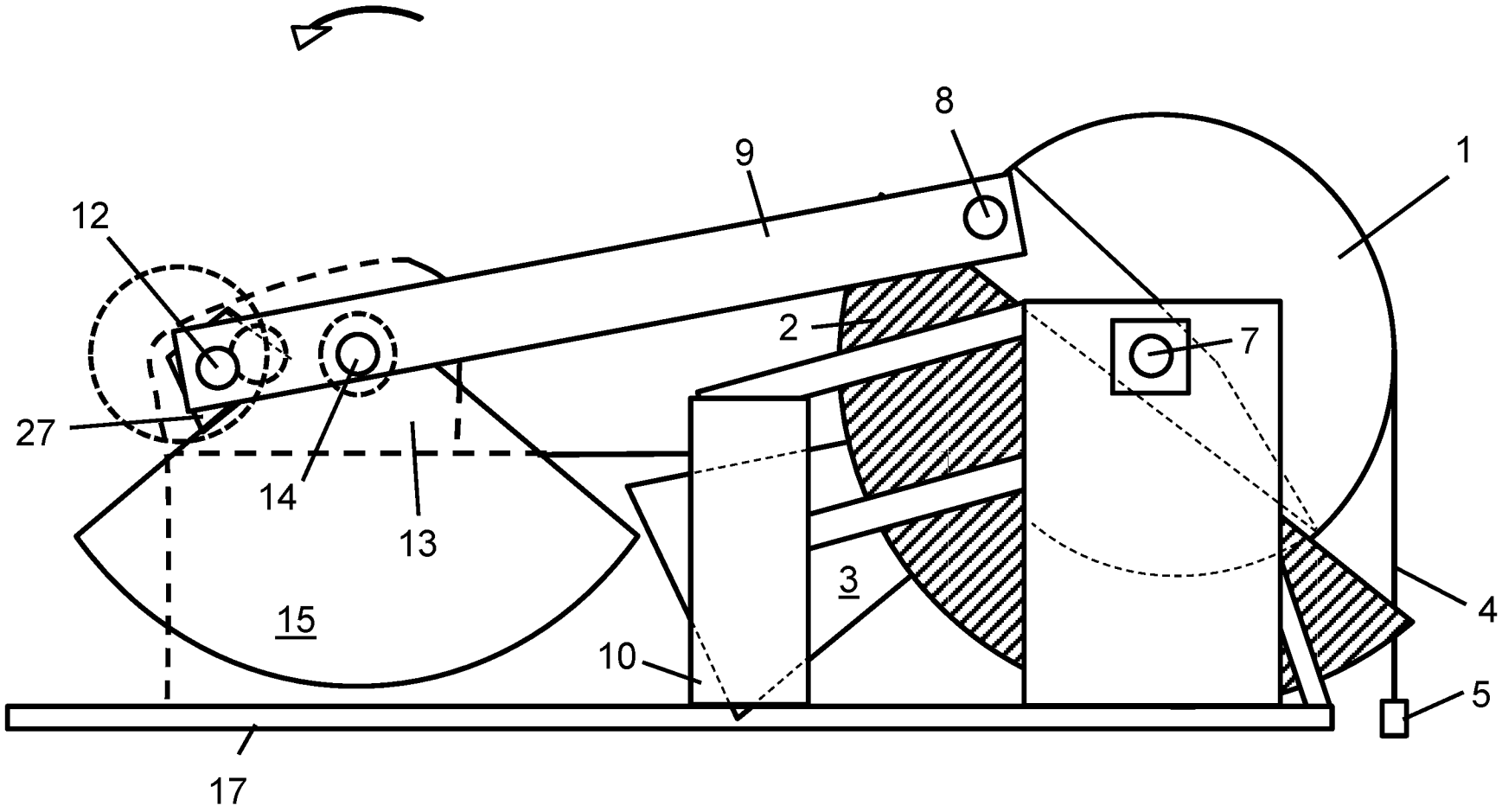
FIG. 9 side view of apparatus with head with contiguous counterweight and extended weight crank arm weight at 180 degrees, in low profile with adjustable stroke length assembly embodiment.

FIG. 9 illustrates an embodiment wherein the low profile configuration is at 180 degrees with the adjustable stroke length assembly 27 and extended weight 3 attached to crank arm weight 15.

Figure 10:
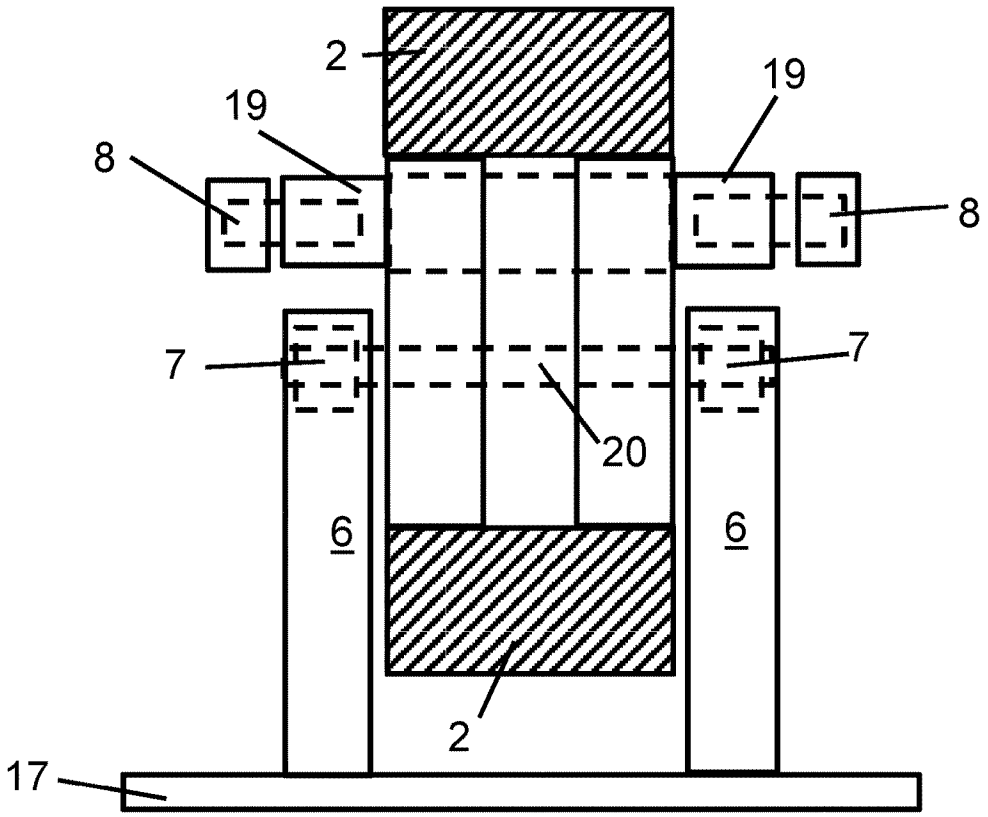
FIG. 10 front view of head assembly with contiguous counterweight and extended weight, in extra low profile embodiment.

FIG. 10 illustrates an embodiment wherein the front view of head 1 assembly with contiguous counterweight 2 in low profile with larger diameter counterweight 2 than head 1 requiring a higher sampson post 6.

FIG. 11 illustrates an embodiment wherein lower connected pitman arm 9 as shown have different stress points than upper connected pitman arm 9 and rotation is clockwise with well on the right. The apparatus is extra low profile, meaning the head 1 and contiguous counterweight 2 and the crank arm weight 15 are the same diameter which achieves the extra low profile for the apparatus but also limits the quantity of effective counterbalance, so this illustration shows an embodiment to increase effective counterbalance with an extended weight 3 attached to the counterweight 2 in a way such that it can adjustably slide and is positioned such that in the upstroke it will still be floor clearing.

FIG. 12 illustrates an embodiment wherein lower connected pitman arm 9 as shown have different stress points than upper connected pitman arm 9 and rotation is clockwise with well on the right. The apparatus is low profile, meaning the contiguous counterweight 2 and the crank arm weight 15 are a larger diameter than the head 1 which still achieves a low profile apparatus but increases the quantity of effective counterbalance over extra low profile. And this illustration shows an embodiment to increase effective counterbalance with an extended weight 3 attached to the counterweight 2 in a way such that it can adjustably slide and is positioned such that in the upstroke it will still be floor clearing.

FIG. 13 illustrates an embodiment wherein lower connected pitman arm 9 as shown give different stress points than upper connected pitman arm 9 and rotation is clockwise with well on the right. This is front view embodiment of head 1 assembly with contiguous counterweight 2 and extended weight 3, in low profile with lower connected pitman arm 9.

Figure 14:
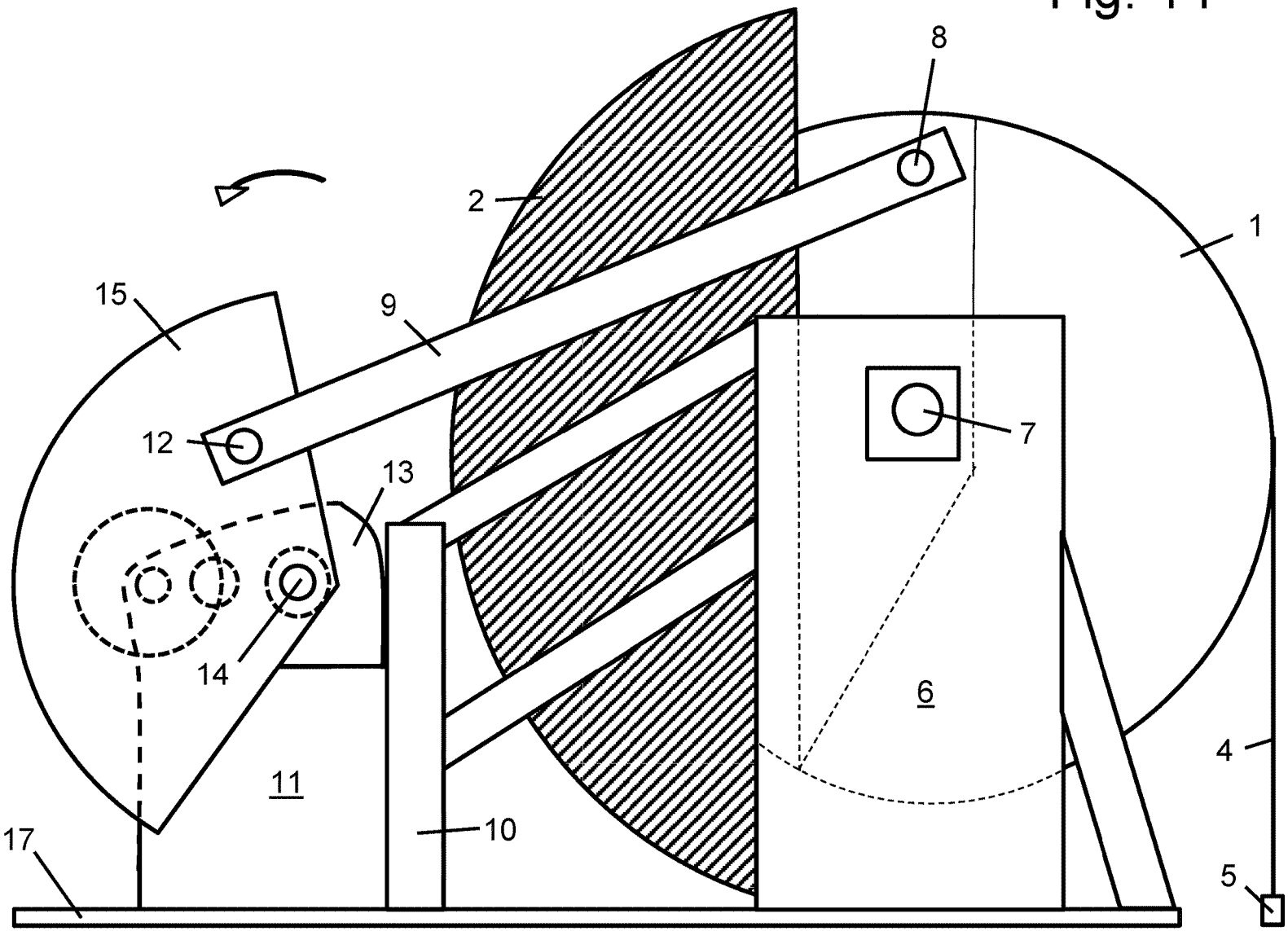
FIG. 14 side view of apparatus with head with contiguous counterweight without extended weight, higher profile with longer stroke length embodiment.

FIG. 14 illustrates an embodiment wherein a higher profile capable of longer stroke length and more effective counterbalance can be achieved by design. In this embodiment the head 1 with contiguous counterweight 2 is without the stinger weight 25.

Figure 15:
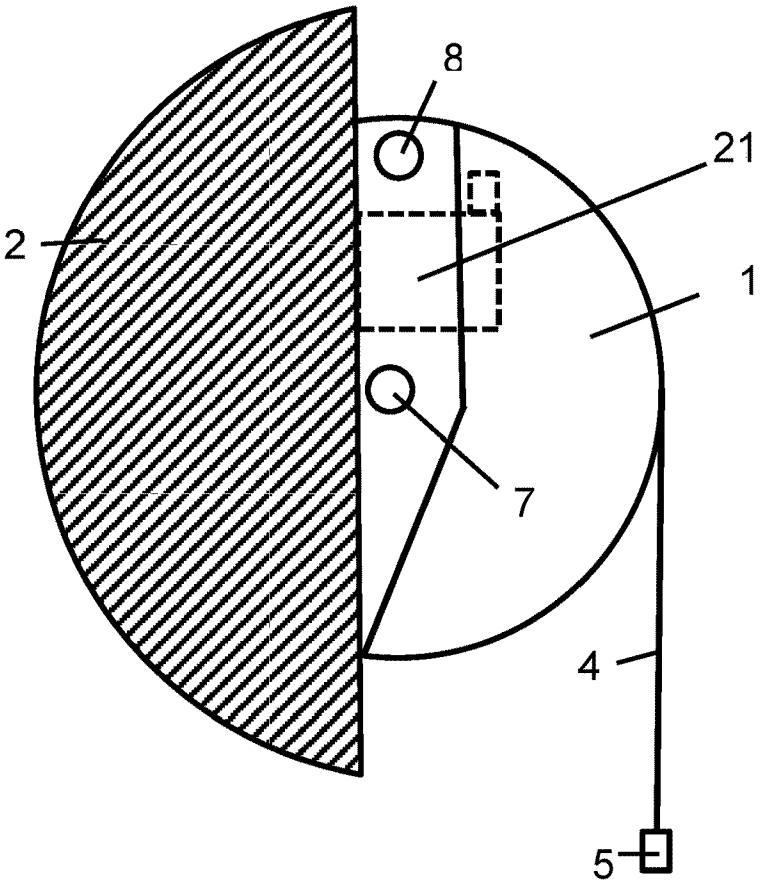
FIG. 15 side view of head assembly with contiguous counterweight in low profile embodiment.

FIG. 15 illustrates an embodiment wherein a side view of head 1 assembly with contiguous counterweight 2 in low profile embodiment shows the head support 21 which allows for removing the head. 1

Figure 16:
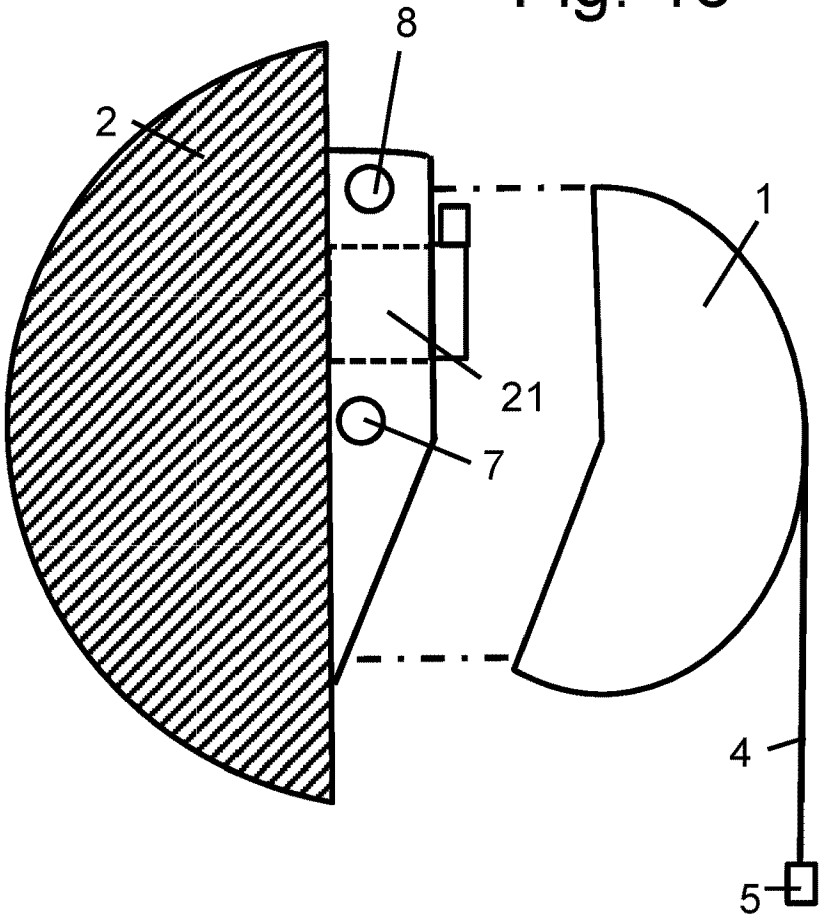
FIG. 16 side view of head assembly with contiguous counterweight without extended weight, with expanded view showing removable section of head in low profile embodiment.
Figure 17:
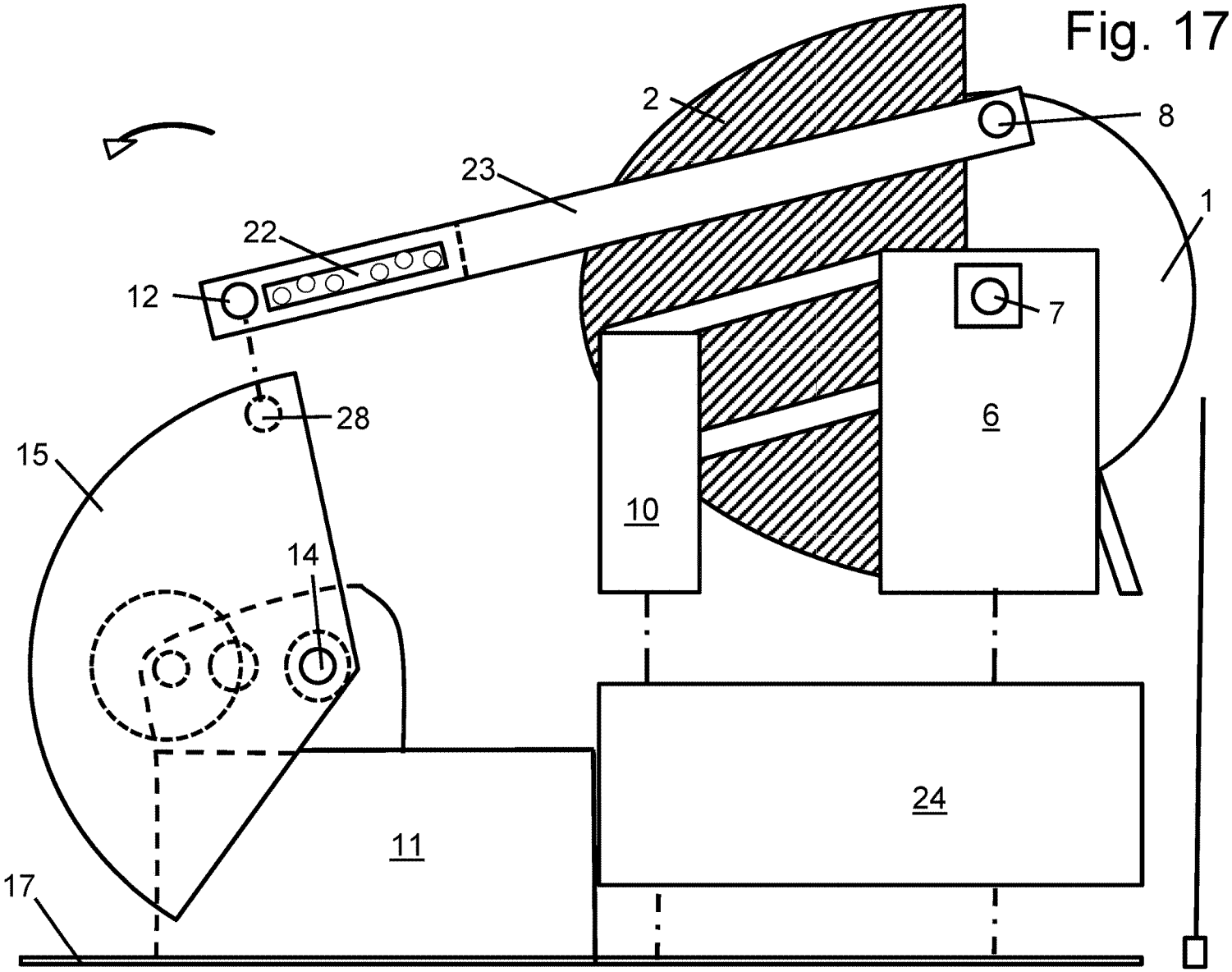
FIG. 17 side view of apparatus with head with contiguous counterweight with Sampson post elevator, extendable pitman arm, larger weight, higher profile embodiment.

FIG. 16 illustrates an embodiment wherein a side view of head 1 assembly with contiguous counterweight 2 with expanded view showing removable section of head 1 removed from the head support 21 in low profile embodiment. Removing the removable section of the head 1 can be accomplished by a service crew and allows a well service pulling unit enough room to perform well maintenance FIG. 17 illustrates an embodiment wherein an expanded view of sampson post elevator 24 and extendable pitman arm 23 of the apparatus with head 1 with contiguous counterweight 2 which allows room for a larger head weight and is a higher profile embodiment which modifies dimensions and kinematics of four link mechanism to achieve a desired pump action.

Figure 18:
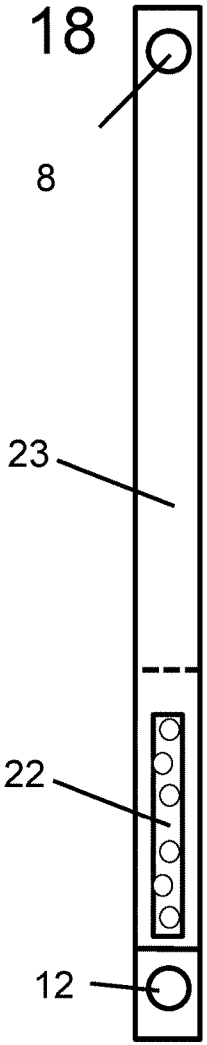
FIG. 18 side view of extendable pitman arm with expansion assembly embodiment.

FIG. 18 illustrates an embodiment wherein a side view of extendable pitman arm 23 with pitman arm expansion assembly 22 shows embodiments including but not limited to bolts or rivets for fastening two structural pieces which can include but are not limited to C-channel or I-beam that can be repositioned for adjusting to desired length and then re-fastened.

Figure 19:
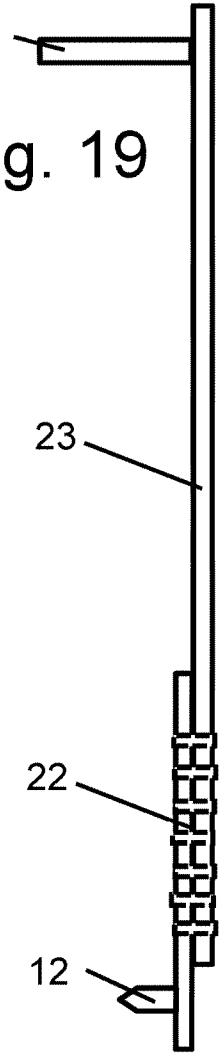
FIG. 19 front view of extendable pitman arm with expansion assembly embodiment.

FIG. 19 illustrates an embodiment wherein an expanded front view of extendable pitman arm 23 with expansion assembly 22 embodiment shows embodiments including but not limited to bolts or rivets fastening two structural pieces which can include but are not limited to C-channel or I-beam that can be repositioned for adjusting to desired length and then re-fastened.

Figure 20:
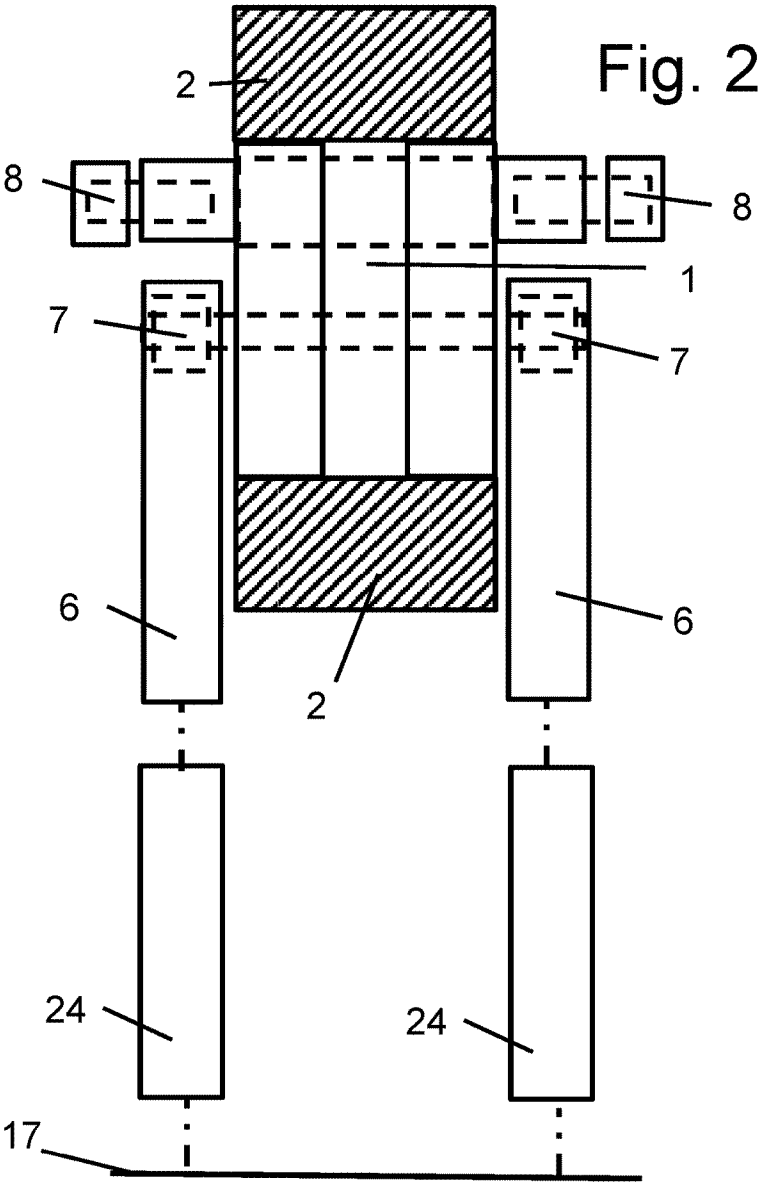
FIG. 20 front view of head assembly with contiguous counterweight and extended weight showing expanded view of Sampson post elevator embodiment.

FIG. 20 illustrates an embodiment wherein an expanded front view of Sampson post elevator 24 embodiment of head 1 assembly with contiguous counterweight 2 and extended weight 3 for use after the apparatus has left the original equipment manufacturer providing a means for multitudes of operator enabled kinematic configurations; such that various downhole rod pump well bore conditions can be optimized by the operator for lifting fluid after the apparatus has left the original equipment manufacturer.

Figure 21:
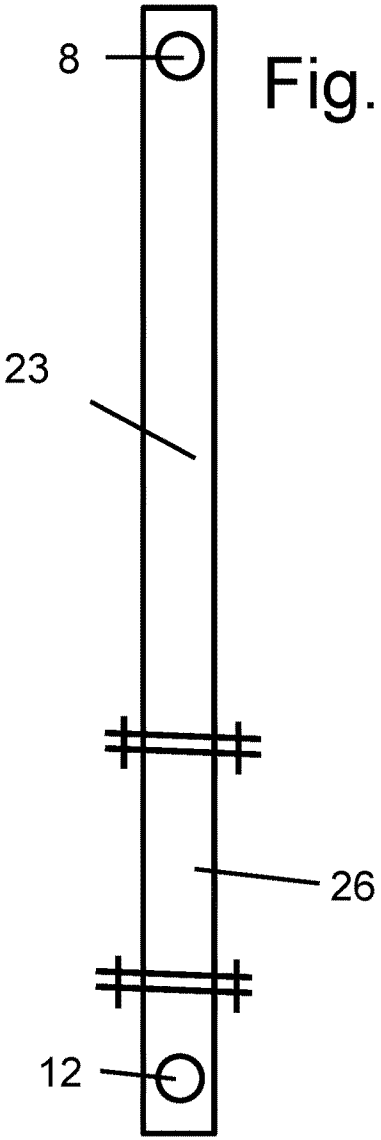
FIG. 21 side view of extendable pitman arm with spacer assembly embodiment.

FIG. 21 illustrates an embodiment wherein a side view of extendable pitman arm 23 with pitman arm spacer 26 assembly embodiment showing embodiments which include but are not limited to bolts or rivets for fastening a pitman arm spacer 26 of material that include but is not limited to C-channel or I-beam that can be inserted for adjusting to desired length and then re-fastened.

Figure 22:
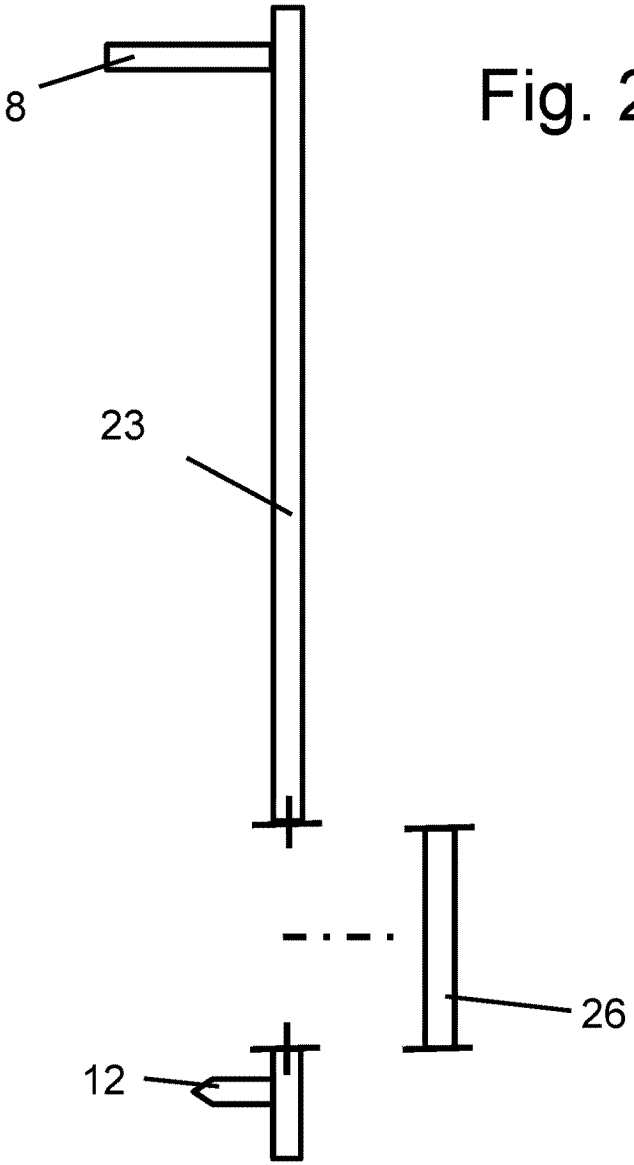
FIG. 22 front view of extendable pitman arm with expanded view of spacer assembly embodiment.

FIG. 22 illustrates an embodiment wherein an expanded front view of extendable pitman arm 23 with pitman arm spacer 26 assembly embodiment showing embodiments that include but are not limited to bolts or rivets for fastening pitman arm spacer 26 material which include but is not limited to C-channel or I-beam that can be inserted for adjusting to desired length and then fastened.

Figure 23:
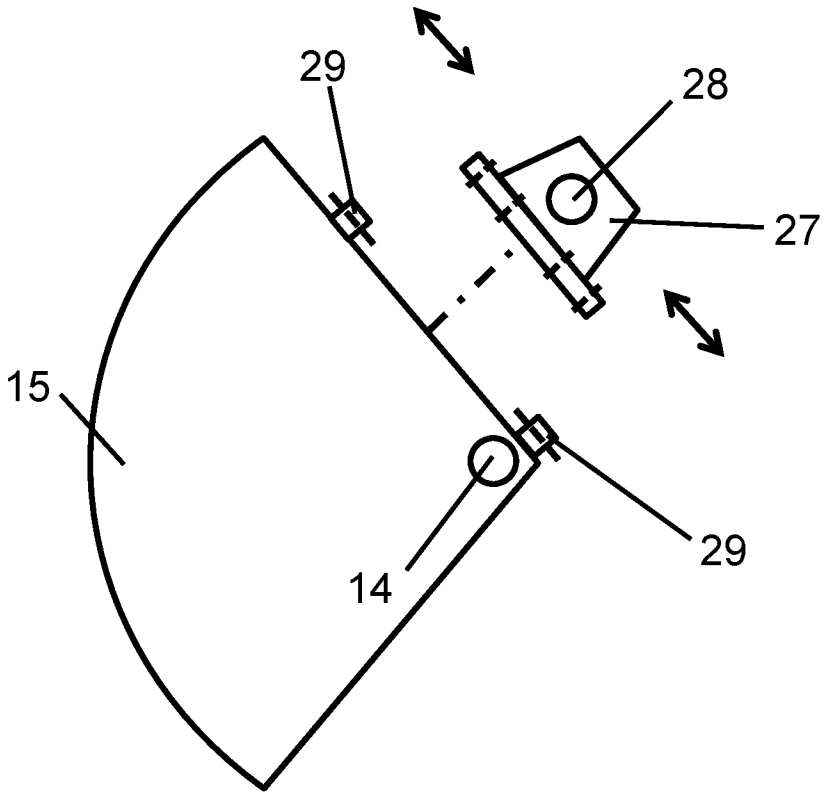
FIG. 23 front expanded view of adjustable stroke length assembly with locking device on crank arm weight.

FIG. 23 illustrates an embodiment wherein an expanded front view of adjustable stroke length assembly 27 with a position locking device 29 on crank arm weight 15. This allows changing stroke length by moving the position of the adjustable stroke length assembly 27 without the necessity to remove the wrist pin 12 from wrist pin 28 hole, and then securely re-fastening the adjustable stroke length assembly 27 to the crank arm weight 15.

Figure 24:
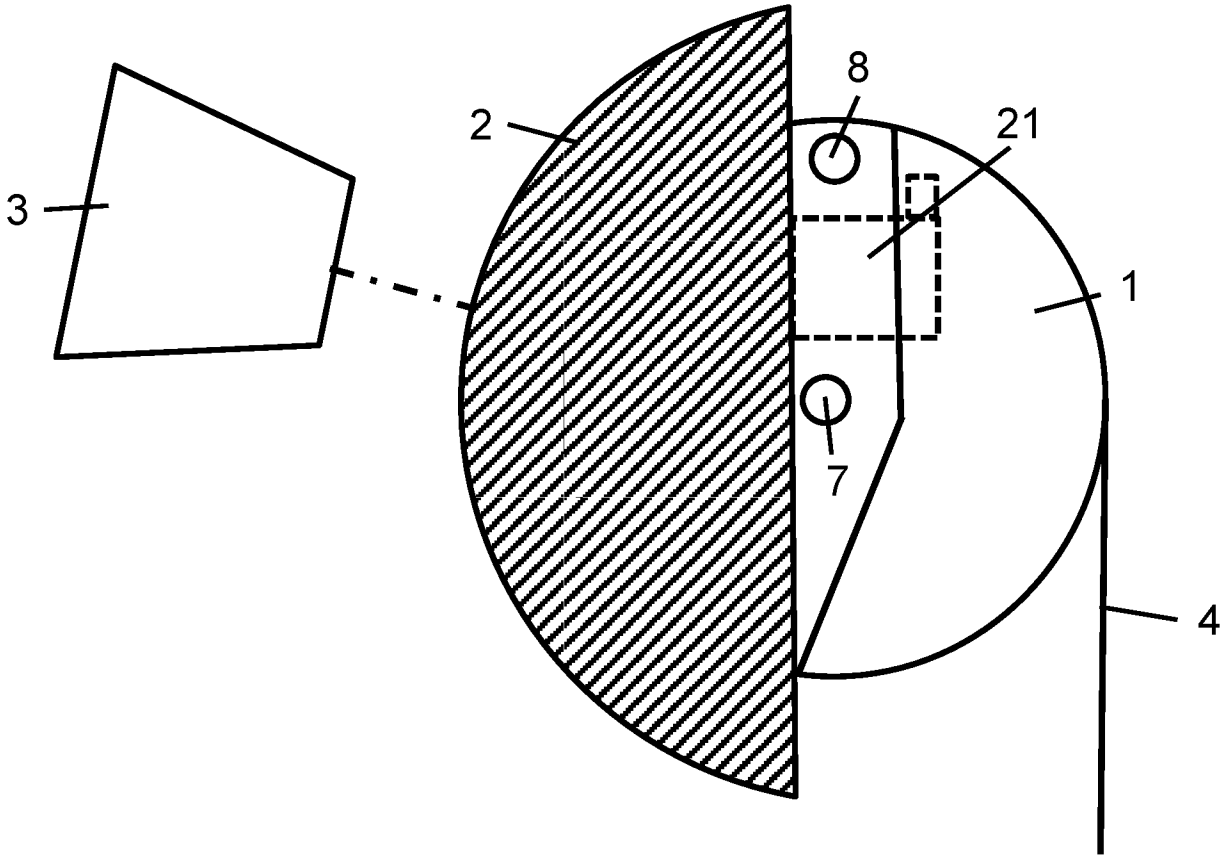
FIG. 24 an expanded side view of extended weight with head assembly with contiguous counterweight in low profile embodiment showing the head support.

FIG. 24 illustrates an embodiment wherein an expanded side view of extended weight 3 with head 1 assembly with contiguous counterweight 2 in low profile embodiment and shows the head support 21 which allows removing the head. 1

Figure 25:
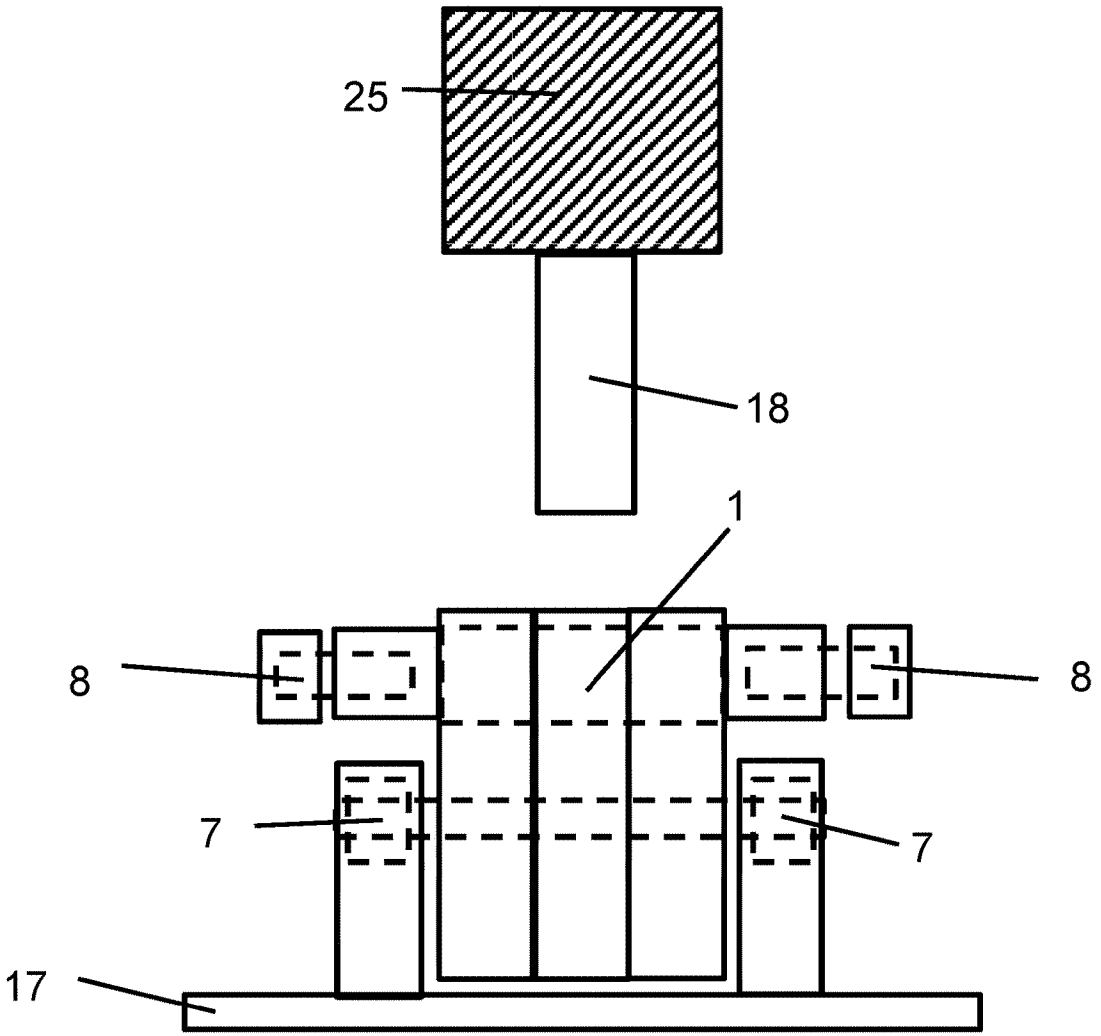
FIG. 25 front view of head assembly with stinger weight in extra low profile embodiment in the down stroke position.

FIG. 25 illustrates an embodiment wherein an expanded front view of head 1 assembly with stinger weight 25 in low profile embodiment. The stinger 18 embodiment can provide additional counterbalance effect.

For traditional beam counterweighted walking beam pumping units, load prediction calculations are directly proportional to the effective beam counterweight. And calculations for rotary counterweight pumping units can include the API 11E standard equation for calculating net speed reducer 13 torque which is:

θ=Angle of crank arm rotation in a clockwise direction viewed with the wellhead to the right and with zero degrees occurring at 12 o'clock degrees, TF=torque factor for a given crank angle (from manufacturer's tables or computed from geometric measurements), B=structural unbalance (from manufacturer or measured), Tn=Net torque, inch-pounds, at the crankshaft for a given crank angle θ, W=polished rod load at any specific crank angle θ, M=maximum moment of the rotary counterweights (from manufacturer or computed from measurements), With these input values Tn=net torque are computed.

Where $TN=TF(W-B)-M \sin \theta$

The rotational motion of crank arm weight 15 causes a maximum moment of rotary crank arm weight 15, crank shaft 14, and crank wrist pin 12 about the crankshaft 14 whose standard nomenclature is written in thousands of inch-pounds. That maximum moment is nominally the position of the maximum effective crank arm weight 15 counterbalance at a little less than 90 degrees and a little less than 270 degrees. 90 degrees and 270 degrees is nominally the position of maximum net torque and maximum requirement for counterbalance effect This invention is desirable to be incorporated in original equipment manufacturing, OEM, on newly manufactured pumping unit. OEM can employ user discretionary dimensions, extension length, and amount of weight to fit the particular specific operational design parameters.

OEM pumping units utilizing this invention can allow for smaller torque capacity speed reducers 13 than those of current practice in known systems because of the increased permissible load on the speed reducer.

Load×Distance from tipping point=Counterweight Mass×Distance from tipping point and is called load moment.

Current practice ECB (effective counterbalance) ~Buoyant weight of rods+1/2 fluid load on pump plunger.

Lowest speed reducer 13 torque loads on pumping units occur at top and bottom of stroke, 0 degrees and 180 degrees, because of low torque factor from unit geometry. And nominal peak speed reducer torque loads occur at high torque factor at about 90 degrees and about 270 degree crank arm weight 15 angles which values are desired to be substantially equal when the pumping unit is balanced in the field at the well using current practice in known systems.

Subsequent operating manuals can address details of these and other operational aspects, where:

Net torque (Tn)=9.53×kilowatt (kw)×efficiency (eff)/strokes per minute (SPM)×speed variation of power transmission (SV).

Torque factor (TF) is used to convert polished rod load to torque (Nm).

Torque due to net well load (TWN)=torque factor (TF)×well load (WN).

Net well load (WN)=well load (*W*)−unit unbalance (SU).

The foregoing embodiments have been presented for the purposes of illustration and description. They are not intended to be exhaustive or to limit the invention and method of use to the precise forms disclosed. The embodiments have been chosen and described in order to best explain the principles and practical application in accordance with the invention to enable those skilled in the art to best utilize the various embodiments with expected modifications as are suited to the particular use contemplated. The present application includes such modifications and is limited only by the scope of the claims.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An oscillating circular arc head contiguous to a counter weight, where in:

the circular arc head is pivotably attached to a center bearing, thereby providing a means for oscillating the head;

the counter weight is at least one mass residing on substantially an opposite side from a load on the circular arc of a head and the counter weight is a plurality of masses residing on substantially the opposite side from the load on the oscillating circular arc of the head;

the counterweight weight is adjustable;

the counterweight position is adjustable;

an adjustable stinger weight can extend from the counter weight contiguous to the head;

the adjustable stinger weight can extend on a stinger head member;

the adjustable stinger weight on the stinger head member can adjust weight amount; and the adjustable stinger weight on the stinger head member can adjust angle.

* * * * *